US005406783A

United States Patent [19]

Kaneko et al.

[11] Patent Number: 5,406,783

[45] Date of Patent: Apr. 18, 1995

[54] ROTOR TYPE OPEN-END SPINNING FRAME WITH YARN PIECING STRUCTURE AND METHOD THEREFOR

[75] Inventors: Masahi Kaneko; Noriaki Miyamoto; Kenji Ito; Yasuyuki Kawai, all of Kariya, Japan

[73] Assignee: Kabushiki Kaisha Toyoda Jidoshokki Seisakusho, Kariya, Japan

[21] Appl. No.: 112,205

[22] Filed: Aug. 26, 1993

[30] Foreign Application Priority Data

Aug. 27, 1992 [JP] Japan ..... 4-228832
Jun. 23, 1993 [JP] Japan ..... 5-152477

[51] Int. Cl.[6] ..... D01H 4/40; D01H 4/50

[52] U.S. Cl. ..... 57/417; 57/263; 57/404; 57/414

[58] Field of Search ..... 57/400, 404, 407, 408, 57/411, 415, 417, 263

[56] References Cited

U.S. PATENT DOCUMENTS 3,481,128 12/1969 Landwehrkamp et al. ..... 57/417
3,834,147 9/1974 Havranek et al. ..... 57/417
4,044,537 8/1977 Negishi et al. ..... 57/417 X
4,166,352 9/1979 Duba ..... 57/417
4,593,522 6/1986 Ishizuka et al. ..... 57/404 X
4,625,506 12/1986 Beckers ..... 57/417 X

FOREIGN PATENT DOCUMENTS 3636182 4/1988 Germany .
4225087 2/1993 Germany .
51-64034 6/1976 Japan .
1533709 11/1978 United Kingdom .

*Primary Examiner*—Daniel P. Stodola
*Assistant Examiner*—William Stryjewski
*Attorney, Agent, or Firm*—Brooks Haidt Haffner & Delahunty

[57] ABSTRACT

A rotor type open-end spinning frame spins a yarn from a fiber bundle formed from unraveled fibers at a fiber collecting section while applying a twist to the fiber bundle during normal spinning, and which pieces the fiber bundle to a standard thread supplied to the fiber collecting section during yarn piecing. The spinning frame has a rotatable outer rotor which has an inner wall with a fiber collecting section. A conduit member is fixed opposite the open-end of the outer rotor and induct the fiber bundle and the standard thread therethrough. An inner rotor is disposed coaxially to and rotatable in the outer rotor. The inner rotor rotates independently of the outer rotor during both normal spinning and yarn piecing. A passage in the inner rotor communicates with the conduit member and guides the fiber bundle from the fiber collecting section to the conduit member during yarn spinning. Another passage in the inner rotor communicates with the conduit member and introduces the standard thread into the fiber collecting section from the conduit member during yarn piecing. A restriction device in the inner rotor retains the fiber bundle within the first passage by engaging with the fiber bundle during yarn spinning.

16 Claims, 22 Drawing Sheets

ROTOR TYPE OPEN-END SPINNING FRAME WITH YARN PIECING STRUCTURE AND METHOD THEREFOR

BACKGROUND OF THE INVENTION

1. Field of the Invention

The present invention relates to a rotor type open-end spinning frame and a yarn ending or piecing method therefor.

2. Description of the Related Art

Of spinning frames, open-end spinning frames which require no roving by a roving frame, can improve the productivity and reduce the cost involving equipment investment, and are therefore widely used. Of the open-end spinning frames, a rotor type is the oldest and has proved as reliable over the years.

In this rotor type open-end spinning frame, a supply sliver is opened by a combing roller to separate impurities. Then, the opened fibers are transported into the rotor by an air stream produced in the fiber transport channel based on the negative pressure in the rotor that is spinning at a high speed, and are collected at the fiber collecting section at the largest inside-diameter portion of the rotor. A bundle of fibers collected at the fiber collecting section is drawn, while being twisted, from the yarn drawing passage, provided on the open side of the rotor coaxial to the rotor, by the action of the drawing roller, and is wound around a bobbin as a package. More specifically, the fiber bundle separated from the fiber collecting section is drawn along the wall of the yarn drawing passage, and at this time, the fiber bundle is drawn while rotating along the inner wall of the yarn drawing passage by the friction to that wall in accordance with the rotation of the rotor, so that the fiber bundle is temporarily twisted, helping the twist propagation of actual twisting.

The fiber bundle collected at the fiber collecting section sticks on the inner wall of the fiber collecting section only by the centrifugal force created by the rotation of the rotor. When the fiber bundle drawn along the yarn drawing passage is twisted, therefore, this twist is propagated to the fiber bundle sticking at the fiber collecting section, causing the fiber bundle in the fiber collecting section to rotate. Therefore, sufficient tension cannot be obtained at the time of twisting so that fibers are twisted while being insufficiently stretched. As a result, the fibers are not twisted straight, resulting in lower strength of yarn, disadvantageously.

As a solution to this problem, Japanese Unexamined Patent Publication No. 51-64034 discloses an apparatus as shown in FIGS. 46 and 47. In this apparatus, a disk-shaped draft rotor (inner rotor) 93 is provided inside an outer rotor 92 having a fiber collecting section 91. The draft rotor 93 makes differential rotation with respect to the outer rotor 92. Formed in the center of the draft rotor 93 is a hole in which a yarn introducing pipe (yarn drawing pipe) 94 is loosely fitted. This hole is perpendicular to a yarn drawing hole 95 for drawing a fiber bundle F collected at the fiber collecting section 91. The draft rotor 93 is provided with a small disk 96 (see FIG. 47) which revolves and rotates while being pressed against the fiber bundle F.

In this apparatus, the draft rotor 93 rotates faster than the outer rotor 92, with a predetermined rotational difference with respect to the outer rotor 92, to draw the fiber bundle F, collected at the fiber collecting section 91, out of the yarn drawing hole 95. Accordingly, this apparatus spins out the fiber bundle F while drafting it. Due to the action of the small disk 96, this apparatus spins out the fiber bundle F while drafting it, with suppressed floating of the fiber bundle F.

As the entrance of the yarn passage to guide the fiber bundle (fleece), separated from the fiber collecting section, is narrow in this conventional apparatus, the standard thread inserted into the yarn passage from the yarn drawing hole 95 reaches the fiber collecting section with difficulty at the time of yarn ending. This results in poor success in yarn ending.

As used throughout this specification it should be understood that "yarn ending" is intended to be synonymous with "yarn piecing".

SUMMARY OF THE INVENTION

It is therefore a primary object of the present invention to provide a rotor type open-end spinning frame which can twist fibers, constituting a fiber bundle that is to be drawn while being twisted, into yarn while being stretched in a relatively straight fashion, thereby yielding yarn having high tensile strength, and a yarn ending method therefor.

It is another object of this invention to provide a rotor type open-end spinning frame which can permit the end of a standard thread to surely reach the fiber collecting section at the time of yarn ending, and a yarn ending method therefor.

To achieve the foregoing and other objects and in accordance with the purpose of the present invention, a rotor type open-end spinning frame of this invention comprises an outer rotor which rotates at a high speed and has a fiber collecting section on its inner wall, and a yarn drawing passage provided on the open side of the outer rotor, with its first end provided coaxial to the outer rotor. An inner rotor, which is actively driven independent of the outer rotor, is provided inside and coaxial to the outer rotor. The inner rotor is formed into such a shape that part of the inner rotor faces the first end of the yarn drawing passage. Formed on the inner rotor are a drawing yarn passage for guiding the fiber bundle, drawn from the fiber collecting section at the time of normal spinning, to the yarn drawing passage, and an introducing yarn passage which connects to the drawing yarn passage and serves to introduce a standard thread at the time of yarn ending. This spinning frame further has restriction means which engages with a fiber bundle, drawn from the fiber collecting section at the normal spin-out time, to restrict the fiber bundle to a predetermined position in the drawing yarn passage.

The inner rotor may be disposed at the opposite position to the opening end of the outer rotor with respect to an imaginary plane where the fiber collecting section lies. The restriction means may be provided with a twist preventing function and may be provided on the inner rotor. The inner rotor may have a guide surface for guiding a fiber bundle, drawn from a standard thread introduced in the introducing yarn passage, to the restriction means. In this case, the fiber bundle drawn from the fiber collecting section is drawn toward the restriction means from a separation point of the fiber collecting section, not directly toward the center of the outer rotor. Therefore, the force necessary to separate the fiber bundle from the fiber collecting section against the centrifugal force, created by the rotation of the outer rotor, becomes small.

The inner rotor may be provided with a recess which is open to the opening end of the outer rotor and where the restriction means is placed. The restriction means may be a pin perpendicular to a lengthwise direction of the inner rotor, with a gap between the pin and the side wall of the largest outside-diameter portion of the recess being set smaller than the diameter of the fiber bundle. In this case, twist prevention is accomplished by the gap between the pin and the wall of the recess.

The pin may be provided in such a way that the rotational center is eccentric to the center of the pin. In this case, even if the thickness of the fiber bundle varies slightly, the pin rotates accordingly, preventing excess force from acting on the fiber bundle. Further, it is unnecessary to adjust the gap between the pin and the wall of the recess in accordance with a change in thickness of the spun yarn which is caused by a change in spinning conditions.

The restriction means may comprise a support lever provided rotatable around a support shaft perpendicular to the lengthwise direction of the inner rotor, and a pin protrusively formed at the distal end of the support lever. The center of gravity of this support lever can be set closer to the pin than to the support shaft and the gap between the pin and the side wall of the largest outside-diameter portion of the recess can be set smaller than the diameter of the fiber bundle. In this case, it is easy to adjust the pressure that acts on the fiber bundle.

The restriction means may be provided at such a position that a distance from the center of the inner rotor becomes smaller than the radius of the fiber collecting section. In this case, the tension applied to the fiber bundle while it moves to the position corresponding to the restriction means becomes smaller than that in the case where the fiber bundle is drawn directly toward the center of the outer rotor from the fiber collecting section. The spinning at the time of fast rotation therefore becomes more stable. As the restriction means is located more inward than the fiber collecting section, the largest outside diameter of the inner rotor can be set about the same as the diameter of the fiber collecting section.

The inner rotor may be disposed at the opposite position to the opening end of the outer rotor with respect to an imaginary plane where the fiber collecting section lies, and the restriction means may be a navel whose distal end is movable between a position corresponding to the imaginary plane and a spin-out position at which the distal end can enter a recess formed in the inner rotor.

The inner rotor may be formed with an introduce passage which connects to the drawing yarn passage and is wider than at least the entrance of the drawing yarn passage. The restriction means may be provided at the entrance of the yarn passage. The restriction means may be a navel whose distal end is movable between a position corresponding to the imaginary plane and a spin-out position as in the above case.

A negative pressure generator may be provided closer to the yarn drawing side than the actual twist point in the yarn drawing passage. In this case, as a suction air stream directing toward the yarn passage is generated by the action of the negative pressure generator, the separation of the fiber bundle and the introduction of the fiber bundle into the yarn passage are carried out smoothly.

In a yarn ending method of the present invention, a passage in the inner rotor for a fiber bundle, drawn from the fiber collecting section and moving toward the yarn drawing passage at the time of normal spinning, is formed separate from a passage for introducing a standard thread at the time of yarn ending in a spinning frame having the aforementioned structure.

To specify a passage in the inner rotor, the aforementioned drawing yarn passage is provided in the inner rotor, and with the outer rotor and inner rotor both rotating, a standard thread is inserted into the introduce passage from the yarn drawing passage at the time of yarn ending. After the leading end of the standard thread reaches the fiber collecting section, the fiber bundle from the fiber collecting section is drawn, together with the standard thread, from the yarn drawing passage through the introduce passage. Thereafter, the fiber bundle may be transported to the drawing yarn passage from the introduce passage to continue the spinning.

DETAILED DESCRIPTION OF THE PREFERRED EMBODIMENTS

First Embodiment

Figure 1:
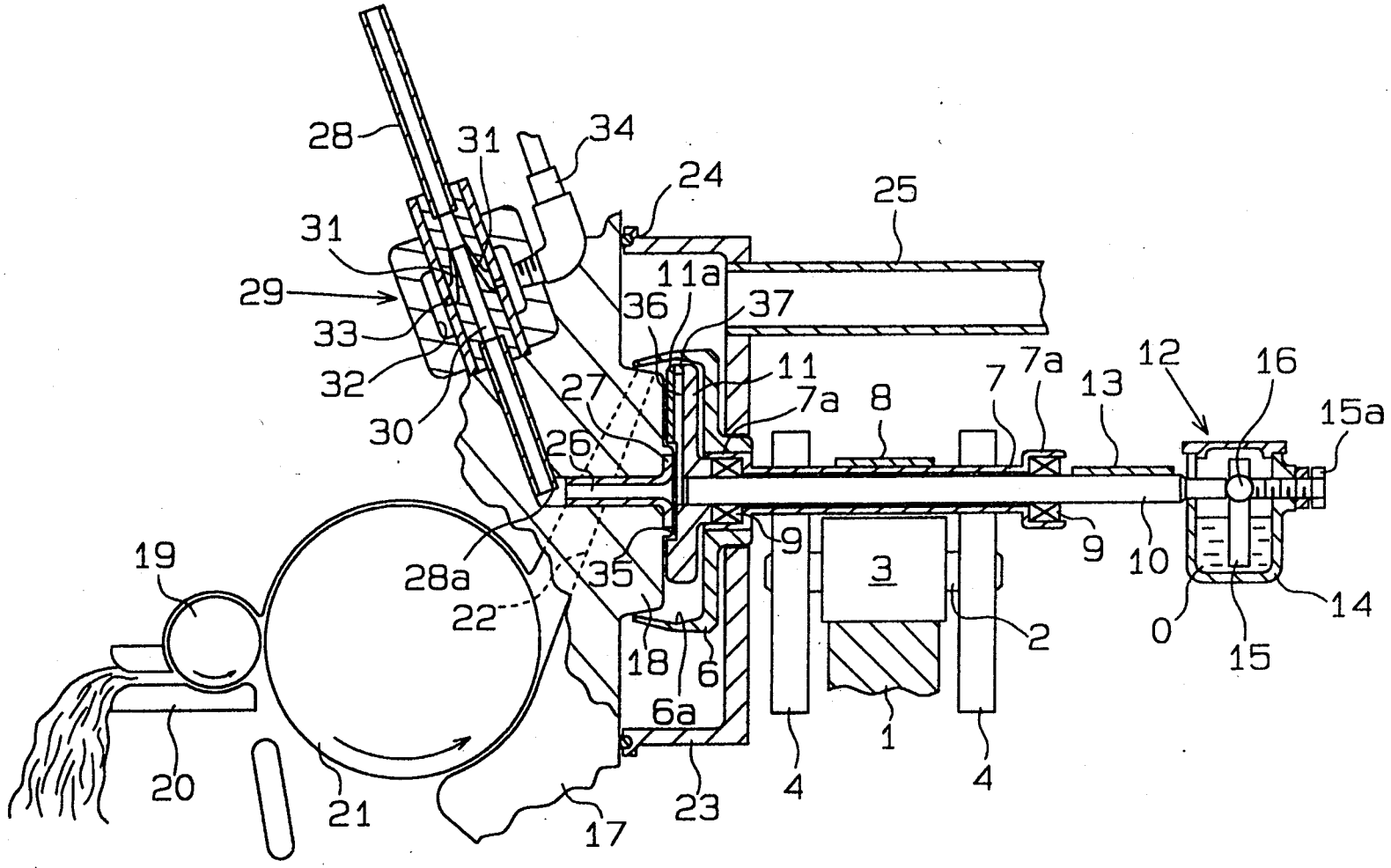
FIG. 1 is a partly cross-sectional view of a spinning frame according to a first embodiment of the present invention.
Figure 2:
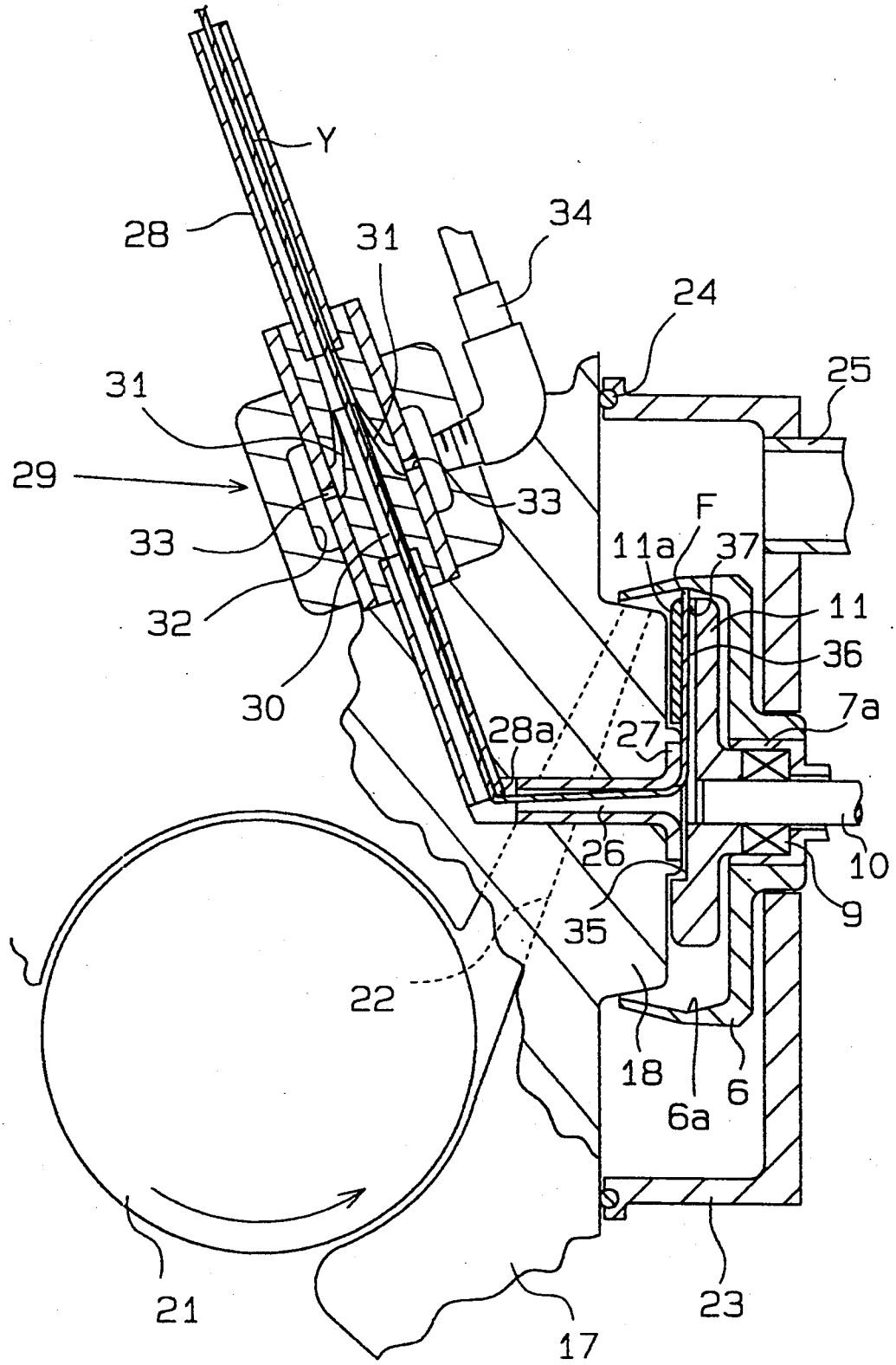
FIG. 2 is a partly enlarged cross section of the spinning frame shown in FIG. 1.

A first embodiment of the present invention will now be described referring to FIGS. 1 through 5. As shown in FIG. 1, a pair of drive shafts 2 (only one shown) is supported, in parallel to each other, via a bearing 3, on a base 1 secured to the frame (not shown) of this embodiment. Support disks 4 are fitted on both sides of each drive shaft 2 so as to be rotatable with that drive shaft 2. A pair of adjoining support disks 4 defines a wedged-shaped recess 5 (shown in FIG. 3). A hollow rotor shaft 7 with an outer rotor 6 securely fitted on the distal end thereof is supported in the recess 5 in such a way that the outer surface of the rotor shaft 7 contacts the individual support disks 4. A drive belt 8 common to a plurality of spindles is arranged between two pairs of support disks 4, in a direction perpendicular to the rotor shaft 7, with the rotor shaft 7 pressed against the support disks 4. As the drive belt 8 is driven by a drive motor (not shown), the rotor shaft 7 rotates with running of the drive belt 8. Bearings 9 are secured in large diameter portions 7*a* formed at both ends of the rotor shaft 7, and a shaft 10 penetrating through the rotor shaft 7 are rotatably supported coaxial to the rotor shaft via the bearings 9. The shaft 10 has a distal end on which an inner rotor 11 is securely fitted to be rotatable with the shaft 10, and a proximal end abutting on a thrust bearing 12. A drive belt 13 provided common to a plurality of spindles, like the drive belt 8, is pressed against the shaft 10 so as to run in a direction perpendicular to the shaft 10. As the drive belt 13 runs, the shaft 10 rotates. The thrust bearing 12 includes a case 14 retaining a lubricating oil "O", a ball 16 rotatably supported on an oil supplying member 15 made of felt, and an adjusting screw 15*a* which abuts on the ball 16 from the opposite side to the shaft 10. The support disks 4 are secured to the drive shafts 2 with slight inclination so that at the time the support disks rotate in accordance with the rotation of the rotor shaft 7, a thrust load directed toward the thrust bearing 12 acts on the rotor shaft 7. The thrust load acting on the rotor shaft 7 is transmitted via the bearings 9 to the shaft 10 and is received by the thrust bearing 12.

A housing 17 is disposed to face the open side of the outer rotor 6, and a boss 18 is formed on the housing 17 so as to protrude inside the outer rotor 6. Bored in the boss 18 is one end of a fiber transport channel 22 which guides fibers, supplied by the actions of a feed roller 19 and a presser 20 and opened by a combing roller 21, into the outer rotor 6. A casing 23, which covers the outer rotor 6, is disposed at the position facing the housing 17 in such a way as to abut via an O ring 24 on the end surface of the housing 17. The casing 23 is connected via a pipe 25 to a negative pressure source (not shown). The inner rotor 11 is secured to the shaft 10 in such a way as to make the gap between itself and the end face of the boss 18 as small as possible in order to provide good sealing between the boss 18 and the inner rotor 11.

A navel 27 in which one end of a yarn drawing passage 26 is bored is provided in the center of the boss 18. The navel 27 is disposed in such a manner that its distal end comes flush with a fiber collecting section **6*a*. An ejector 29 serving as a negative pressure generator is disposed in a midway of a yarn pipe 28 which constitutes the downstream portion of the yarn drawing passage 26. The yarn pipe 28 is so laid as to cross the center line of the navel 27, and its end portion 28*a* closer to the yarn drawing passage 26 is a yarn twist start point. The ejector 29 has a passage 30 provided in the center portion, a plurality of eject holes 31, provided outside the passage 30, for ejecting compressed air toward the outlet side (yarn drawing side) of the passage 30, and an annular chamber 32 provided outside the eject holes 31. The chamber 32 is connected to the individual eject holes 31 through holes 33, and has an opening to which a compressed air supply pipe 34 is connected. The compressed air supply pipe 34 is connected to a compressed air source (not shown), with a pressure regulator and a valve (neither shown) provided in a midway of the pipe 34. The ejector 29 is designed to generate negative pressure on the entrance side of the passage 30 as the compressed air with a given pressure, supplied via the compressed air supply pipe 34 from the compressed air source, is ejected through the eject holes 31**.

The inner rotor 11 is so designed that part of its surface extends to the proximity of the fiber collecting section **6*a* of the outer rotor 6, and has a recess 35 formed in the center portion on that side which corresponds to the boss 18. The navel 27 is to be freely fitted in the recess 35. The radius of the largest outside-diameter portion of the inner rotor 11 is set larger than the radius of the inner wall of the opening of the outer rotor 6. A yarn passage 36 is formed at the largest outside-diameter portion of the inner rotor 11, extending in the radial direction thereof. The yarn passage 36 has a first end portion open in the vicinity of the fiber collecting section 6*a* of the outer rotor 6 and a second end portion open in the surface of the recess 35. A twist propagation preventing portion 37 is provided at the entrance of the yarn passage 36, at the corner on the side where the separation point of the fiber bundle F moves. The twist propagation preventing portion 37, constituted of a shaft having many rugged portions on the outer surface, is secured to the distal end of the inner rotor 11** with the shaft positioned perpendicular to the moving direction of the fiber bundle F. This shaft is secured by means of screw-in, adhesive, press fitting, etc. The rugged portions are so formed as to extend in the drawing direction of the fiber bundle F and to be smaller than the diameter of the fiber bundle F and larger than the diameter of fibers.

Figure 3:
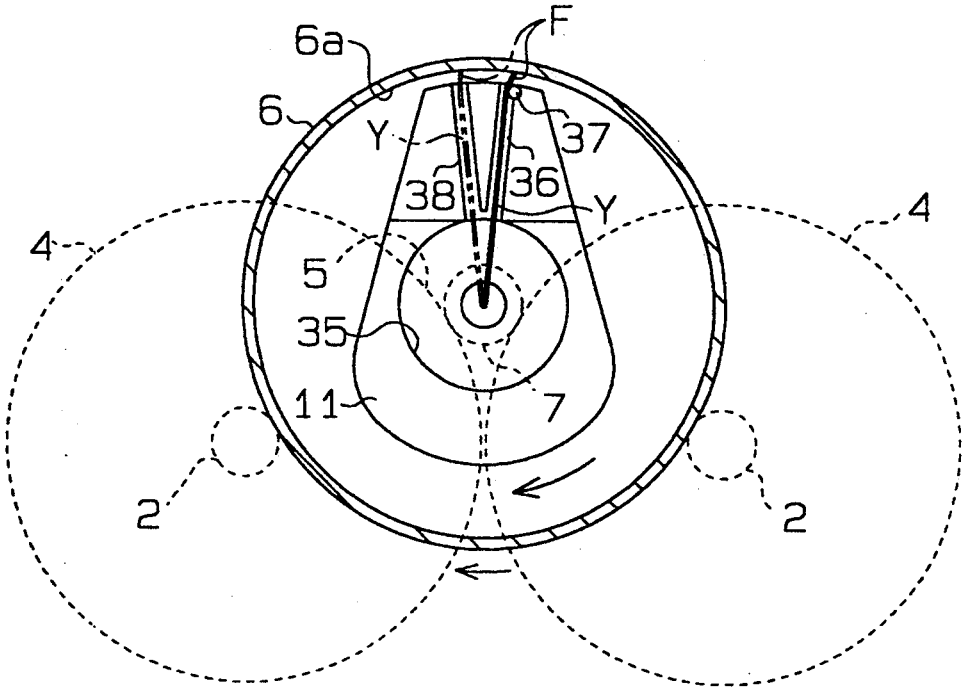
FIG. 3 is a partly cross-sectional view showing the relationship between an outer rotor and an inner rotor and a support disk and a rotor shaft, with portions omitted, as viewed from the opening side of the outer rotor.
Figure 4:
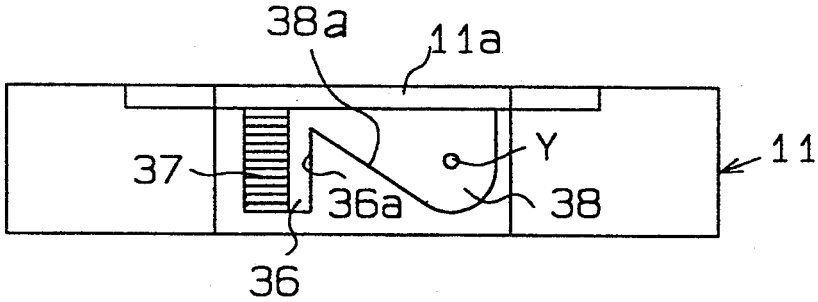
FIG. 4 is a schematic diagram of the inner rotor at the time of yarn ending as viewed from the entrance side of a yarn passage.
Figure 5:
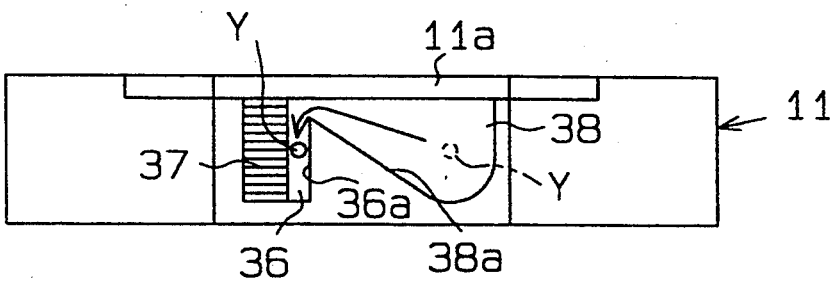
FIG. 5 is a schematic diagram of the inner rotor at the time of normal spinning as viewed from the entrance side of the yarn passage.

As shown in FIGS. 3 and 4, an introduce passage 38, which is connected to the yarn passage 36 on the opening side of the outer rotor 6, is formed at the largest outside-diameter portion of the inner rotor 11 in such a way as to extend in the radial direction of the inner rotor 11. The introduce passage 38, like the yarn passage 36, has a first end portion open in the vicinity of the fiber collecting section **6*a* of the outer rotor 6 and a second end portion open in the surface of the recess 35. As shown in FIG. 4, for example, the introduce passage 38 is so formed that its wall 38*a* on the side corresponding to the yarn passage 36 extends obliquely toward the link portion between the passages 36 and 38. A wall 36*a* of the yarn passage 36 on the side corresponding to the introduce passage 38 is formed to extend nearly vertically. This wall 36*a* constitutes restriction means to restrict the movement of the fiber bundle F toward the introduce passage 38. A cover plate 11*a* is securely attached to that portion of the inner rotor 11 where the yarn passage 36 and introduce passage 38** are formed.

The action of the thus structured spinning frame will be described below. In spinning mode, the drive belts 8 and 13 run in the same direction to rotate the outer rotor 6 and inner rotor 11 in the same direction via the rotor shaft 7 and shaft 10, so that the fiber bundle F is sequentially separated from the fiber collecting section **6*a* to enter the yarn passage 36. The rotational speed of the inner rotor 11 is slightly slower than the speed of separation of the fiber bundle F from the fiber collecting section 6*a* (slightly faster than the rotational speed of the outer rotor 6). Compressed air is supplied through the compressed air supply pipe 34 to the ejector 29 from the compressed air source, causing a suction action in the yarn drawing passage 26 upstream of the ejector 29 (outer rotor side) to provide negative pressure higher than that in the outer rotor 6. In this state, the fibers, which have been opened by the action of the combing roller 21 are fed into the outer rotor 6 via the fiber transport channel 22, slide along the inner wall of the outer rotor 6 to be collected at the fiber collecting section 6*a* which is the largest inside-diameter portion. The fiber bundle F collected at the fiber collecting section 6*a* is smoothly separated from the fiber collecting section 6*a* and guided into the yarn passage 36 by the suction air stream, generated based on the negative pressure in the yarn passage 36 and flowing toward the yarn passage 36**.

The fiber bundle F is linked to yarn Y which is drawn through the yarn pipe 28 by a drawing roller (not shown). As the yarn Y is drawn, the fiber bundle F is drawn as the yarn Y, while being twisted by the rotation of the inner rotor 11. The twisting applied to the yarn Y and fiber bundle F is transmitted upstream from the end portion **28*a* of the yarn pipe 28 as the start point. The fiber bundle F is introduced into the yarn passage 36 while in contact with the twist propagation preventing portion 37 provided at the entrance of the yarn passage 36. Consequently, the rotation of the fiber bundle F is suppressed at that portion, so that the rotation of the yarn and fiber bundle which are drawn while being twisted, is suppressed from being propagated to the fiber bundle F upstream of the position corresponding to the twist propagation preventing portion 37. That is, twisting is stopped at the position corresponding to the twist propagation preventing portion 37**. At the twisting time, therefore, the fiber bundle F is twisted while the fibers are stretched by the tension applied thereto, so that the fibers are twisted straight, thus increasing the strength of yarn and yielding tight yarn.

As the upstream propagation of the twisting of the fiber bundle F from the position corresponding to the twist propagation preventing portion 37 is prevented as described above, the fiber bundle F which has just been separated from the fiber collecting section 6a has a low strength. As the inner rotor 11 is actively driven at a predetermined speed independent of the outer rotor 6, however, the force acting on the fiber bundle F at the time of separation becomes stable, thus ensuring smooth separation of the fiber bundle F. As the suction air stream directed toward the yarn passage 36 is generated by the action of the ejector 29, thus ensuring smooth separation of the fiber bundle F and smooth introduction of the fiber bundle F into the yarn passage 36.

At the time of yarn ending, the rotational speed of the inner rotor 11 is set equal to the speed of separation of the fiber bundle F from the fiber collecting section 6a in order to reduce the yarn tension on the fiber bundle F. With the outer rotor 6 and inner rotor 11 rotating, the supply of the compressed air to the ejector 29 is stopped. As a result, the negative pressure in the outer rotor 6 acts on the yarn drawing passage 26, generating an air stream toward the entrances of the yarn passage 36 and introduce passage 38 from the yarn drawing passage 26 via the recess 35. As the introduce passage 38 has a cross-sectional area larger than the yarn passage 36, more air enters the introduce passage 38 than the yarn passage 36. When the standard thread is inserted into the yarn drawing passage 26 from the yarn pipe 28 in this condition, the standard thread is introduced to the introduce passage 38 where a larger amount of an air stream is running. Due to the action of the air stream and the centrifugal force, the distal end of the standard thread is smoothly led to the entrance and reaches the fiber collecting section 6a. When the drawing roller (not shown) is driven forward to draw the standard thread, the fiber bundle (fleece) F collected at the fiber collecting section 6a is wound around the end portion of the standard thread and is separated from the fiber collecting section 6a to be drawn. That is, the yarn Y is spun while being drawn out of the introduce passage 38 at the initial stage of the yarn ending as indicated by the chain line in FIG. 3 and the solid line in FIG. 4. The rotational speed of the outer and inner rotors 6, 11 can be reduced at the time of the above yarn ending, thus further improving the success rate of yarn ending.

Then, the rotational speed of the inner rotor 11 is set slower than the speed of separation of the fiber bundle F. This produces force which causes the yarn in the introduce passage 38 to move toward the yarn passage 36, so that the yarn Y moves along the wall 38a toward the yarn passage 36 and enters the passage 36. As the wall 36a of the yarn passage 36 on the side of the introduce passage 38 is formed perpendicular to the rotational surface of the inner rotor 11 and the yarn passage 36 is narrower, the yarn Y, once introduced into the yarn passage 36, does not escape the passage 36. Thereafter, the yarn Y is spun while being drawn from the yarn passage 36 as indicated by the solid line in FIG. 3.

Second Embodiment

A second embodiment of the present invention will now be described referring to FIGS. 6 through 10. This embodiment differs from the first embodiment in the shapes of the introduce passage 38, formed in the inner rotor 11, and the twist propagation preventing portion 37 and the structure of the navel 27. The yarn passage 36 is formed in the center portion of the largest outside-diameter portion of the inner rotor 11, and the twist propagation preventing portion 37 is provided at the entrance of the yarn passage 36 at that corner portion in which direction the separation point of the fiber bundle F moves. The introduce passage 38 is connected to the yarn passage 36 at that portion of the inner rotor 11 which is on the opening side of the outer rotor 6, and is integrally formed with the same width as the yarn passage 36. In other words, as the twist propagation preventing portion 37 is provided at the entrance of the yarn passage 36, the yarn passage 36 becomes narrower than the introduce passage 38 accordingly.

Figure 9:
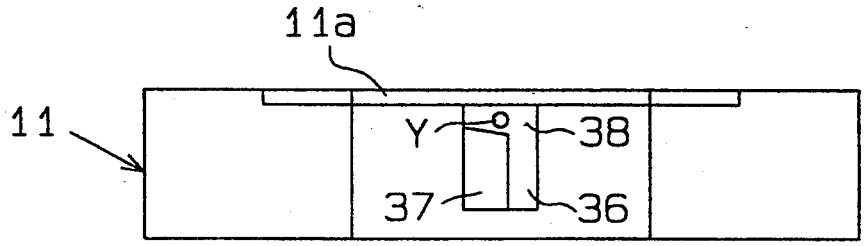
FIG. 9 is a schematic diagram of an inner rotor at the time of yarn ending as viewed from the entrance side of a yarn passage.
Figure 10:
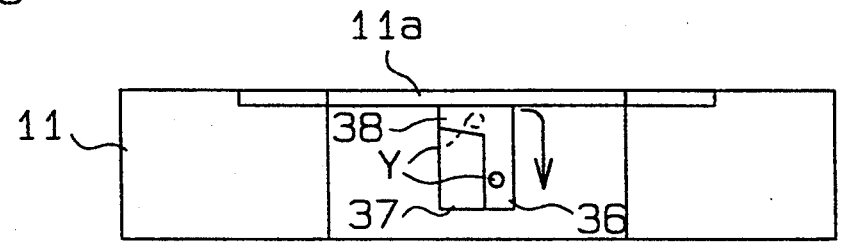
FIG. 10 is a schematic diagram of the inner rotor at the time of normal spinning as viewed from the entrance side of the yarn passage.

As shown in FIGS. 9 and 10, the twist propagation preventing portion 37 is formed into a column shape so that the end face corresponding to the introduce passage 38 extends obliquely in a direction away from the introduce passage 38.

The navel 27 is supported movable along the axis of the inner rotor 11 while its cylindrical section 27a inserted into the housing 17 and a cylindrical guide member 39 with a bottom, which is secured to the housing 17. The guide member 39 has a guide groove 39a formed therein. Formed in the middle portion of the cylindrical section 27a is an opening which is connected to the yarn pipe 28. An engaging section 27b is protrusively provided, penetrating the guide groove 39a, on the outer surface of the proximal end of the cylindrical section 27a in a direction perpendicular to the cylindrical section 27a. The guide groove 39a has such a shape as to move the navel 27 in the axial direction when the engaging section 27b is rotated by a rotary solenoid (not shown).

Figure 6:
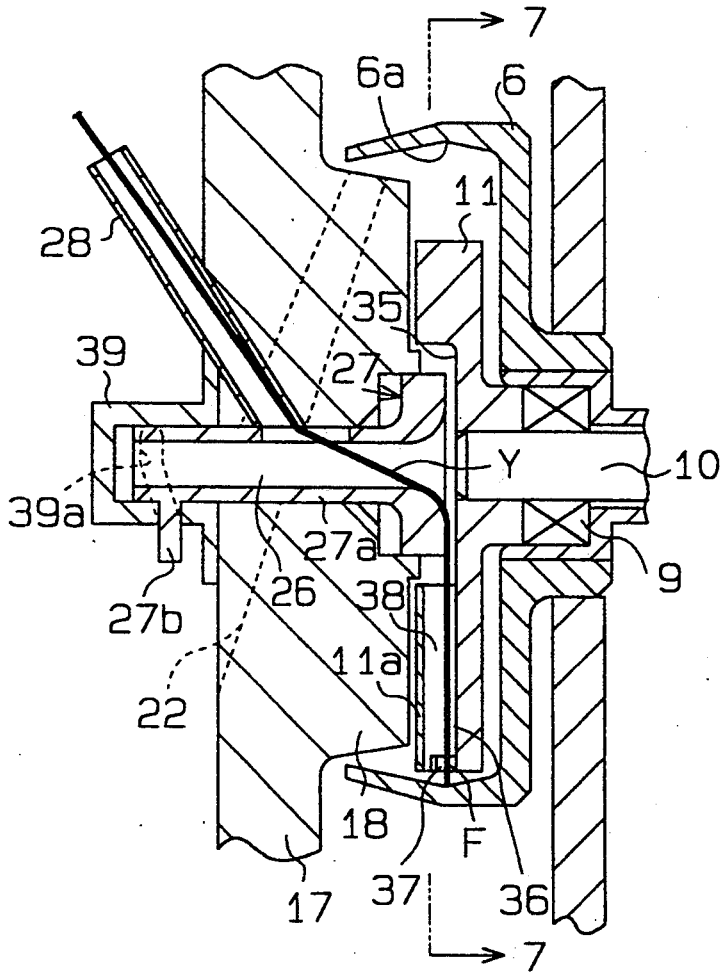
FIG. 6 is a partly cross-sectional view showing the normal spinning state of a spinning frame according to a second embodiment.
Figure 7:
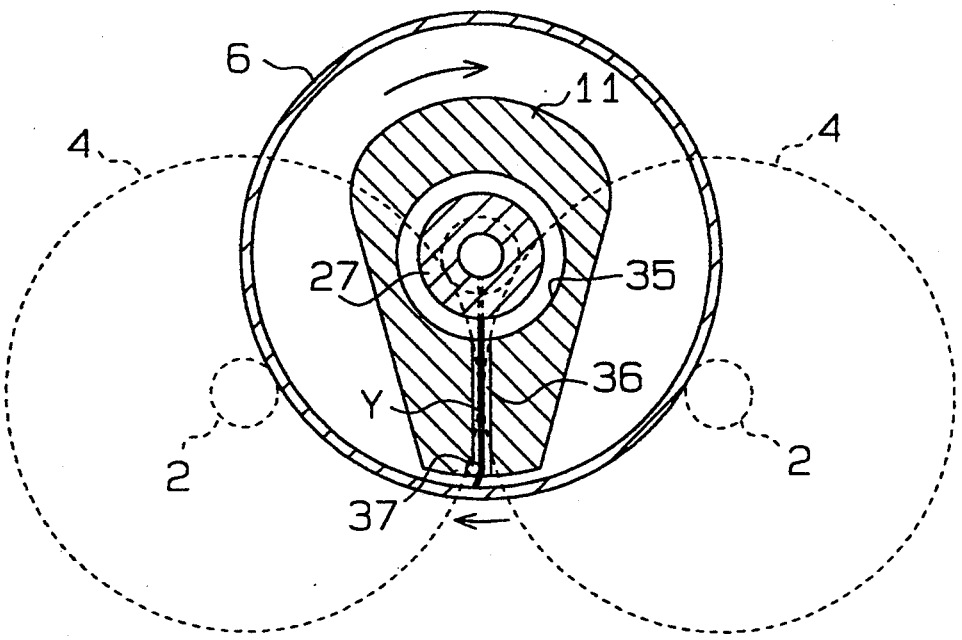
FIG. 7 is a reduced cross section taken along line 7—7 in FIG. 6.

In the rotor type open-end spinning frame according to this embodiment, the navel 27 is disposed at the spin position at which its distal end comes flush with the fiber collecting section 6a at the time of normal spinning as shown in FIG. 6. In this state, the fiber bundle F separated from the fiber collecting section 6a travels through the yarn passage 36 while contacting the twist propagation preventing portion 37, and is drawn out of the yarn drawing passage 26. At the twisting time, therefore, the fiber bundle F is twisted while the fibers are stretched by the tension applied thereto, so that the fibers are twisted straight, thus increasing the strength of yarn and yielding tight yarn, as in the previous embodiment.

Figure 8:
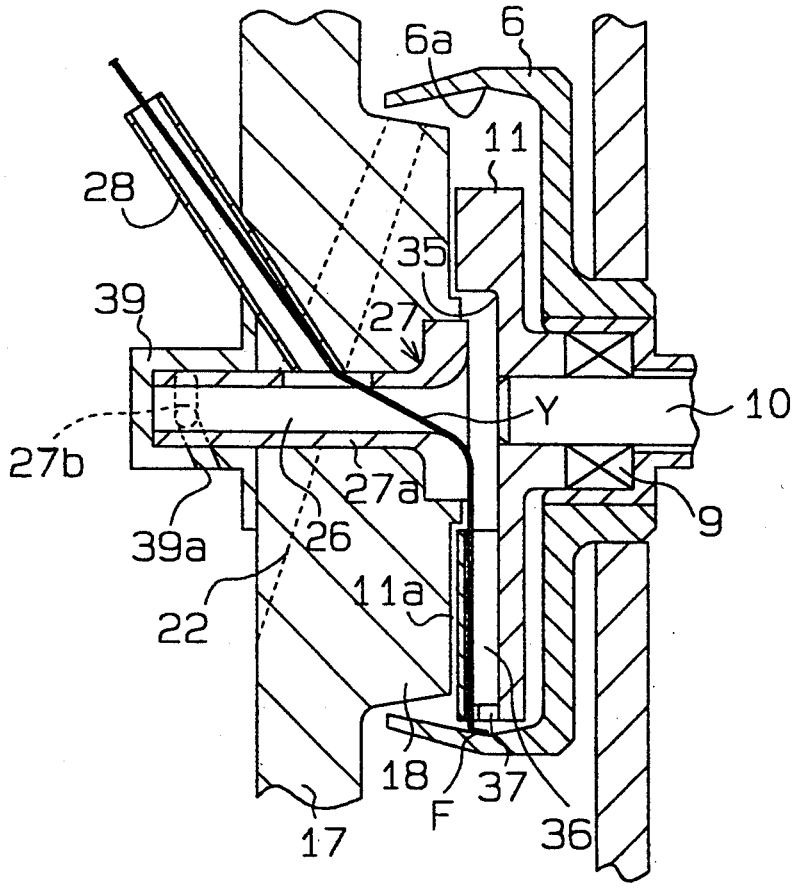
FIG. 8 is a partly cross-sectional view showing the state of the spinning frame at the time of yarn ending.

At the time of yarn ending, the distal end of the navel 27 comes closer to the opening side of the outer rotor 6 than the distal end of the twist propagation preventing portion 37, as shown in FIG. 8. With the outer rotor 6 and inner rotor 11 rotating, the supply of the compressed air to the ejector 29 is stopped, as in the previous embodiment. Under this condition, the standard thread is inserted into the yarn drawing passage 26 from the yarn pipe 28. The standard thread moves toward the inner wall of the outer rotor 6 by the air stream flowing into the recess 35, yarn passage 36 and introduce passage 38 from the yarn drawing passage 26 and the centrifugal force created by the rotation of the inner rotor 11. As the distal end of the navel 27 is positioned closer to the opening side of the outer rotor 6 than the distal end of the twist propagation preventing portion 37, the standard thread travels inside the introduce passage 38. After the distal end of the standard thread reaches the inner wall of the outer rotor 6 at the position closer to the opening side of the outer rotor 6 than the fiber collecting section 6a, it slides along that inner wall to reach the fiber collecting section 6a.

Then, the standard thread is drawn by the forward rotation of the drawing roller (not shown), and the fiber bundle F collected at the fiber collecting section 6a is wound around the end portion of the standard thread. Accordingly, the fiber bundle F is separated from the fiber collecting section 6a and is drawn together with the standard thread. That is, the yarn Y is spun while being drawn out of the introduce passage 38 at the initial stage of the yarn ending as shown in FIGS. 8 and 9.

Then, the navel 27 is moved in the axial direction and is disposed at the spin position at which its distal end comes flush with the fiber collecting section 6a as shown in FIG. 6. As shown in FIG. 10, the yarn Y in the introduce passage 38 moves toward the yarn passage 36 in accordance with the movement of the navel 27. By the time the movement of the navel 27 is complete, as shown in FIG. 6, the fiber bundle F separated from the fiber collecting section 6a has moved through the yarn passage 36 while contacting the twist propagation preventing portion 37, and is ready to be drawn out of the yarn drawing passage 26. In this embodiment, therefore, the navel 27 constitutes restriction means to restrict the movement of the fiber bundle F, introduced in the yarn passage 36, toward the introduce passage 38.

Third Embodiment

Figure 11:
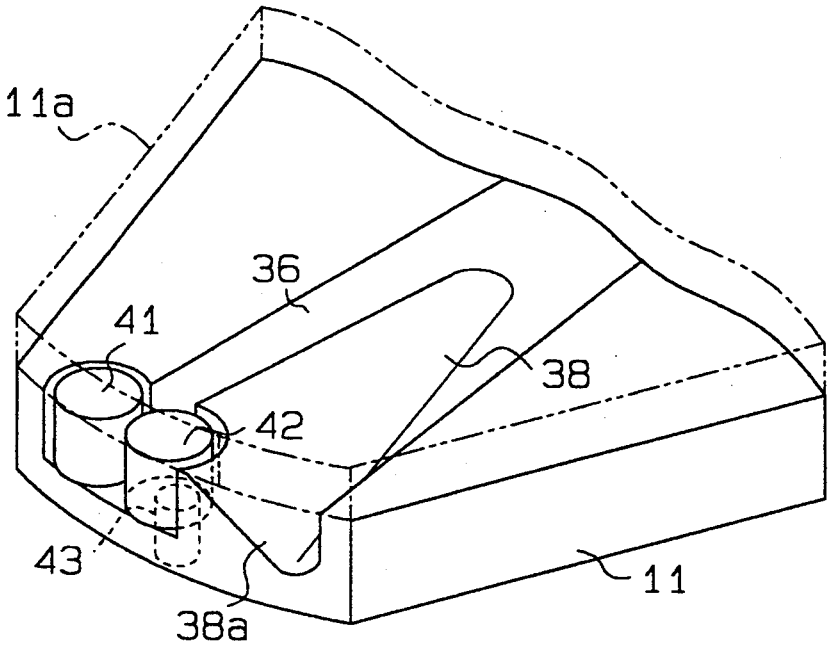
FIG. 11 is a partly perspective view of an inner rotor according to a third embodiment as viewed from the opening side of an outer rotor.
Figure 12:
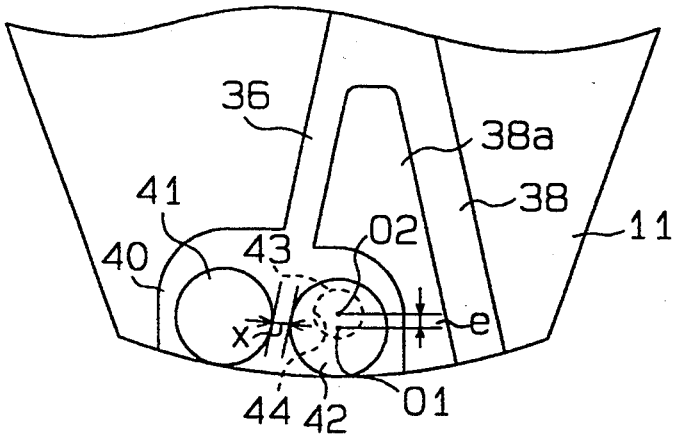
FIG. 12 is a schematic diagram also showing the inner rotor, with a cover plate omitted, as viewed from the opening side of the outer rotor.
Figure 13:
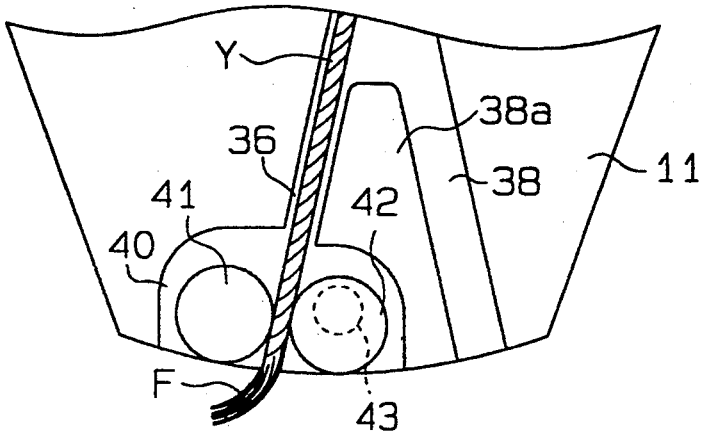
FIG. 13 is a schematic diagram showing the state of contact members at the spinning time, with the cover plate omitted.
Figure 14:
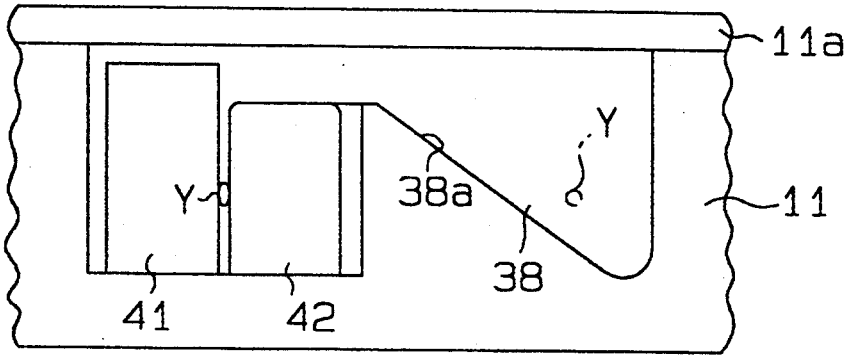
FIG. 14 is a diagram of the inner rotor, with portions omitted, as viewed from the entrance side of a yarn passage.

A third embodiment of the present invention will now be described referring to FIGS. 11 through 14. This embodiment differs from the above-described two embodiments in the structure of the twist propagation preventing portion 37. The introduce passage 38 in this embodiment has basically the same shape as the one in the first embodiment. Formed at the distal end of the inner rotor 11 and at the position corresponding to the entrance of the yarn passage 36 is a retaining recess 40 which is open toward the housing 17 and fiber collecting section 6a. That portion of the recess 40 on the side of the housing 17 is closed by the cover plate 11a. As shown in FIGS. 11 to 13, the recess 40 is so formed as to expand on both sides of the yarn passage 36, with a set of columnar contact members 41 and 42 disposed in the recess 40 to sandwich the yarn passage 36. Both contact members 41 and 42 constitute the twist propagation preventing portion 37. As shown in FIG. 14, the first contact member 41 is formed taller than the second contact member 42. The first contact member 41 is fixed unmovable to the inner rotor 11. The second contact member 42 has a pin 43 protruding from a position eccentric to the center O1. This pin 43 is rotatably supported in a support hole 44 formed in the inner rotor 11. The center O2 of the pin 43 is eccentric to the center O1 of the second contact member 42 by a distance "e". The position of the pin 43 is set in such a way that with the center O1 of the second contact member 42, the center O2 of the pin 43 and the rotational center of the inner rotor 11 being aligned on a straight line, the gap "X" between both contact members 41 and 42 is smaller than the thickness of the fiber bundle at the entrance.

The action of the spinning frame with the above-described structure will be explained. At the time of spinning, as in the above-described two embodiments, the fiber bundle F collected at the fiber collecting section 6a is smoothly separated therefrom, and is drawn as yarn Y in accordance with the drawing of the yarn Y, while being twisted by the rotation of the inner rotor 11. The fiber bundle F is introduced into the yarn passage 36 while in contact with both contact members 41 and 42 provided at the entrance of the yarn passage 36. In spinning mode in which the fiber bundle lies between the contact members 41 and 42, the second contact member 42 is not at the position where the center O1 of the second contact member 42, the center O2 of the pin 43 and the rotational center of the inner rotor 11 come on a straight line. As a result, the centrifugal force acting on the second contact member 42 according to the rotation of the inner rotor 11 urges the second contact member 42 to rotate in such a direction (clockwise in FIG. 13) that the center O1 of the second contact member 42, the center O2 of the pin 43 and the rotational center of the inner rotor 11 come on a straight line. In other words, the force which pushes the fiber bundle F toward the first contact member 41 always acts on the second contact member 42 during spinning.

Thus, both sides of the fiber bundle F moving in the yarn passage 36 are pressed against the contact members 41 and 42 at the position corresponding to those contact members 41 and 42. Consequently, the rotation of the fiber bundle F is suppressed at that portion, thus suppressing the propagation of the rotation of the yarn and fiber bundle, drawn while being twisted, to the fiber bundle F located upstream of the position corresponding to both contact members 41 and 42. That is, twisting is stopped at the position corresponding to both contact members 41 and 42. Because the second contact member 42 is rotatable around the pin 43, even if the thickness of the fiber bundle F varies slightly, the second contact member 42 rotates around the pin 43 accordingly, preventing excessive force from acting on the fiber bundle F.

At the time of yarn ending, first, the standard thread is introduced into the introduce passage 38 in the same condition as given in the first embodiment, and spinning is conducted with the yarn Y drawn from the introduce passage 38 as indicated by the chain line in FIG. 14. Then, the rotational speed of the inner rotor 11 is set slower than the moving speed of the separation point. This produces force to move the yarn Y in the introduce passage 38 toward the yarn passage 36, causing the yarn Y to move toward the yarn passage 36 along the wall 38a. As a plane, which passes the distal end of the navel 27 and fiber collecting section 6a, passes through nearly the lengthwise center of the first contact member 41, the yarn Y is introduced to the position in the yarn passage 36 where it is held between both contact members 41 and 42, as indicated by the solid line in FIG. 14. Thereafter, spinning is performed with the yarn Y drawn from the yarn passage 36 as indicated by the solid line in FIG. 14.

Fourth Embodiment

Figure 15:
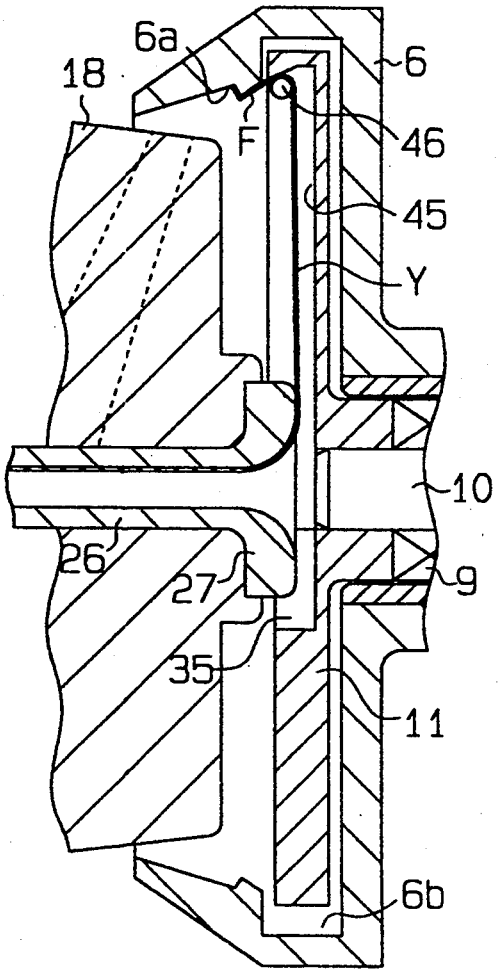
FIG. 15A is a partly cross-sectional view showing the normal spinning state of a spinning frame according to a fourth embodiment.
FIG. 15B is an exemplary diagram showing the forces acting on a fiber bundle.
Figure 15:
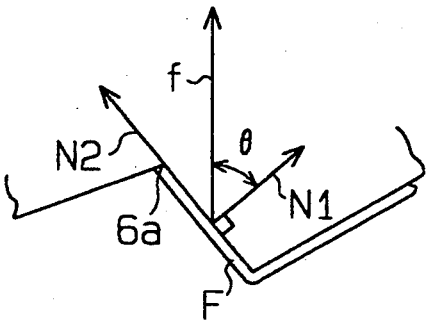
Figure 16:
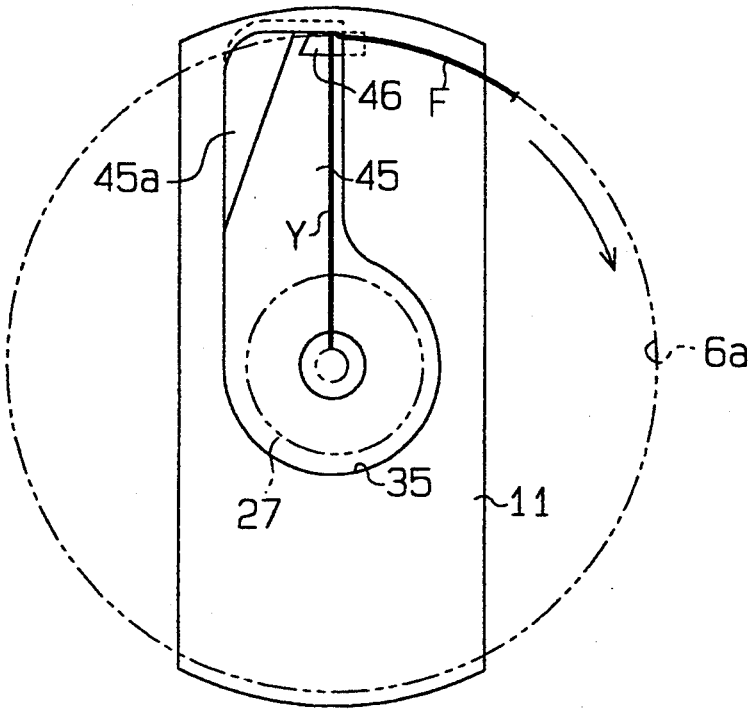
FIG. 16 is a schematic diagram of an inner rotor at the time of normal spinning as viewed from the entrance side of an outer rotor.

A fourth embodiment of the present invention will now be described referring to FIGS. 15 through 21. This embodiment differs considerably from the above-described embodiments in that in normal spinning mode, the position where the fiber bundle F (yarn Y) passes during the period in which the fiber bundle F is drawn from the fiber collecting section 6a and is guided to the navel 27, differs from an imaginary plane on which the fiber collecting section 6a lies. As shown in FIG. 15A, a retaining section 6b larger in diameter than the fiber collecting section 6a is formed in the outer rotor 6 on the opposite side to the opening side thereof with the fiber collecting section 6a therebetween. The inner rotor 11 has a shape of a disk whose both sides are cut out symmetrically, its largest outside-diameter portion larger than the diameter of the fiber collecting section 6*a*, and is securely fitted on the shaft 10 while being accommodated in the retaining section 6*b*.

Formed in the inner rotor 11 is a recess 45 which stretches to the recess 35 where the navel 27 is loosely fitted. The recess 45 stretches to the vicinity of the first end portion of the inner rotor 11. The recess 45 is formed on the rear side in the spinning rotational direction of the inner rotor 11 (the direction of the arrow in FIG. 16). The navel 27 is disposed at such a position that its distal end is located closer to the bottom side of the outer rotor 6 (opposite side to the opening side) than the imaginary plane containing the fiber collecting section 6*a*. The fiber collecting section 6*a* is indicated by the chain line in FIG. 16. The recess 45 serves as a yarn passage for introduction of the standard thread and a drawing yarn passage to guide the fiber bundle F, drawn from the fiber collecting section 6*a*, to the position facing the yarn drawing passage 26 at the time of normal spinning.

The radius of the largest inside-diameter portion of the recess 45 is set larger than that of the fiber collecting section 6*a*, while that portion of the recess 45 close to the largest outside-diameter portion of the inner rotor 11 has such a shape that the diameter of the bottom portion is larger than that of the opening edge portion, i.e., the recess 45 is scooped toward the first end portion of the inner rotor 11. A pin 46 serving as restriction means is protrusively formed in the recess 45 at a position close to the first end portion of the inner rotor 11, in such a way that it is perpendicular to the lengthwise direction of the inner rotor 11 and provides a gap between itself and the opening edge of the recess 45 on the first end portion side. A groove 46*a* for determining the drawing position of the fiber bundle F is formed close to the proximal end of the pin 46. That side of the distal end of the pin 46 which corresponds to the first end portion side of the recess 45 is obliquely cut away toward the proximal end side. A slanted guide surface 45*a* is formed on the first end portion side of the recess 45 at the position facing the pin 46.

The action of the spinning frame with the above-described structure will be explained. In spinning mode, the fiber bundle F collected at the fiber collecting section 6*a* is drawn therefrom toward the inner rotor 11 along the wall of the outer rotor 6 as shown in FIG. 15A. Then, the fiber bundle F is wound around the pin 46, changing its drawing direction toward the naval 27. The fiber bundle F is drawn as yarn Y while being twisted by the rotation of the inner rotor 11. Because the clearance between the pin 46 and the wall 45*b* of the recess 45 is small and the fiber bundle F is drawn while being wound around the pin 46, the rotation of the fiber bundle F is suppressed at the point where it is wound around the pin 46. That is, the rotation of the yarn Y and fiber bundle F, drawn while being twisted, is suppressed from propagating to the fiber bundle F located upstream of the position corresponding to the pin 46.

In the above-described embodiments, the fiber bundle F is drawn directly toward the center of the outer rotor 6 from the fiber collecting section 6*a*, and is guided to the entrance of the yarn passage 36 of the inner rotor 11. Therefore, the fiber bundle F is drawn with the centrifugal force, produced by the rotation of the outer rotor 6, acting against the force to draw the whole fiber bundle F. That is, large tension is applied to the fiber bundle F which has not been twisted. As the centrifugal force is proportional to the square of the angular velocity, with the outer rotor 6 rotating fast, it is difficult to draw the untwisted fiber bundle F directly toward the center of the outer rotor 6 from the fiber collecting section 6*a* against the centrifugal force.

According to this embodiment, however, the fiber bundle F collected at the fiber collecting section 6*a* is drawn toward the inner rotor 11 along the wall of the outer rotor 6, and is then drawn toward the center of the outer rotor 6 at the position of the pin 46. The fiber bundle F slides, untwisted, on the walls of the outer rotor 6 and inner rotor 11 up to the position corresponding to the pin 46. Therefore, the tension necessary to move the fiber bundle F has only to be large enough to overcome the component of the centrifugal force in the direction of the wall and the frictional resistance between the fiber bundle F and the wall.

Provided that the centrifugal force acting on the fiber bundle F is "f", the frictional coefficient between the fiber bundle F and the wall is $\mu$ and the angle defined by the direction perpendicular to the wall and the acting direction of the centrifugal force is $\Theta$ as shown in FIG. 15B, the force N1 acting on the fiber bundle F and the force N2 acting in parallel to the wall are expressed by the following equations:

$$N1 = f \times \cos\Theta,\ N2 = f \times \sin\Theta.$$

Thus, the tension T necessary to move the fiber bundle F is given by the following equation:

$$T = f \times \sin\Theta + \mu \times f \times \cos\Theta.$$

As the frictional coefficient $\mu$ is $10^{-1}$ and $\cos\Theta$ and $\sin\Theta$ are smaller than one, the tension T becomes smaller than the centrifugal force "f", so that the fiber bundle F, although untwisted, smoothly moves to the position corresponding to the pin 46 from the fiber collecting section 6*a*. At the position where the drawing direction of the fiber bundle F is opposite to the direction of the centrifugal force and is toward the naval 27 from the pin 46, the fiber bundle F is twisted. Even with the outer rotor 6 rotating fast, the fiber bundle F can be drawn smoothly.

The action in yarn ending mode will be described next. At the time of yarn ending, the rotational speed of the inner rotor 11 is set equal to the speed of separation of the fiber bundle F from the fiber collecting section 6*a* and slightly faster than the rotational speed of the outer rotor 6. With the outer rotor 6 and inner rotor 11 rotating, the supply of the compressed air to the ejector 29 is stopped. As a result, the negative pressure in the outer rotor 6 acts on the yarn drawing passage 26, generating an air stream going into the outer rotor 6 from the yarn drawing passage 26. When the standard thread is inserted into the yarn drawing passage 26 from the yarn pipe 28 in this condition, the distal end of the standard thread reaches the fiber collecting section 6*a* due to the action of the air stream and the centrifugal force. When the drawing roller (not shown) is driven forward to draw the standard thread, the fiber bundle F collected at the fiber collecting section 6*a* is wound around the end portion of the standard thread and is separated from the fiber collecting section 6*a* to be drawn.

Figure 17:
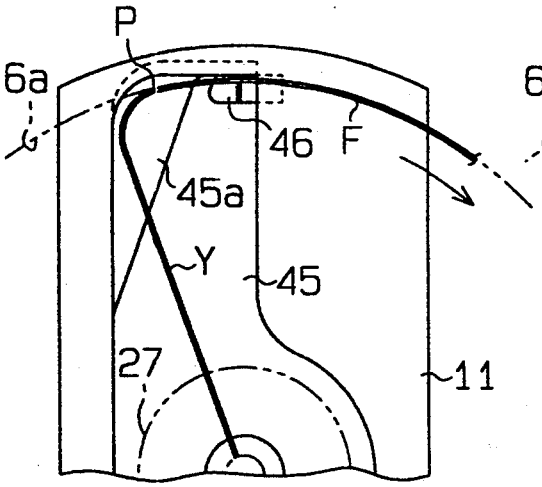
FIG. 17A is a schematic diagram showing the relationship between a fiber bundle and the inner rotor at the initial stage of yarn ending.
FIG. 17B is a schematic diagram showing a state immediately before the engagement of a fiber bundle with a pin.
Figure 17:
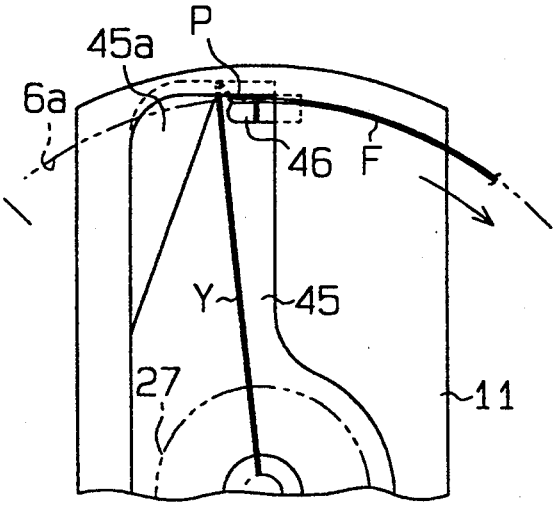
Figure 18:
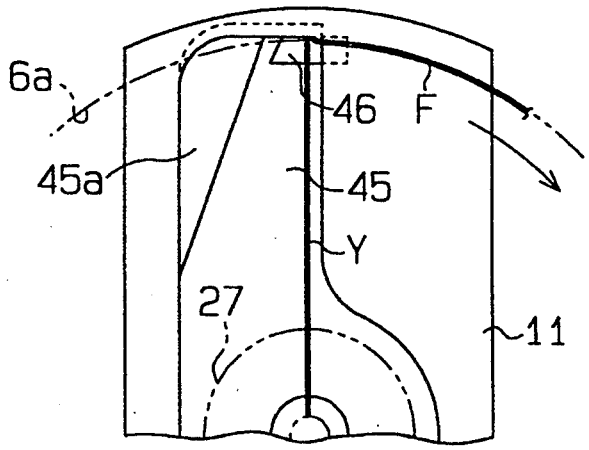
FIG. 18 is a schematic diagram showing the fiber bundle engaged with the pin.
Figure 19:
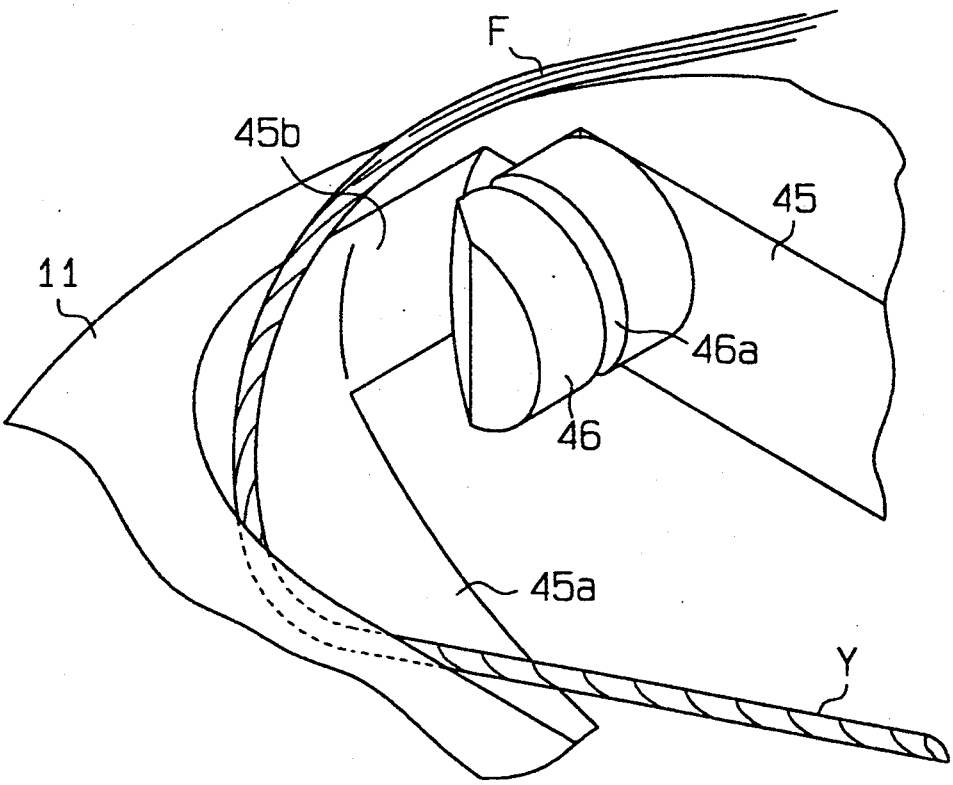
FIG. 19 is a schematic perspective view corresponding to FIG. 17A.
Figure 20:
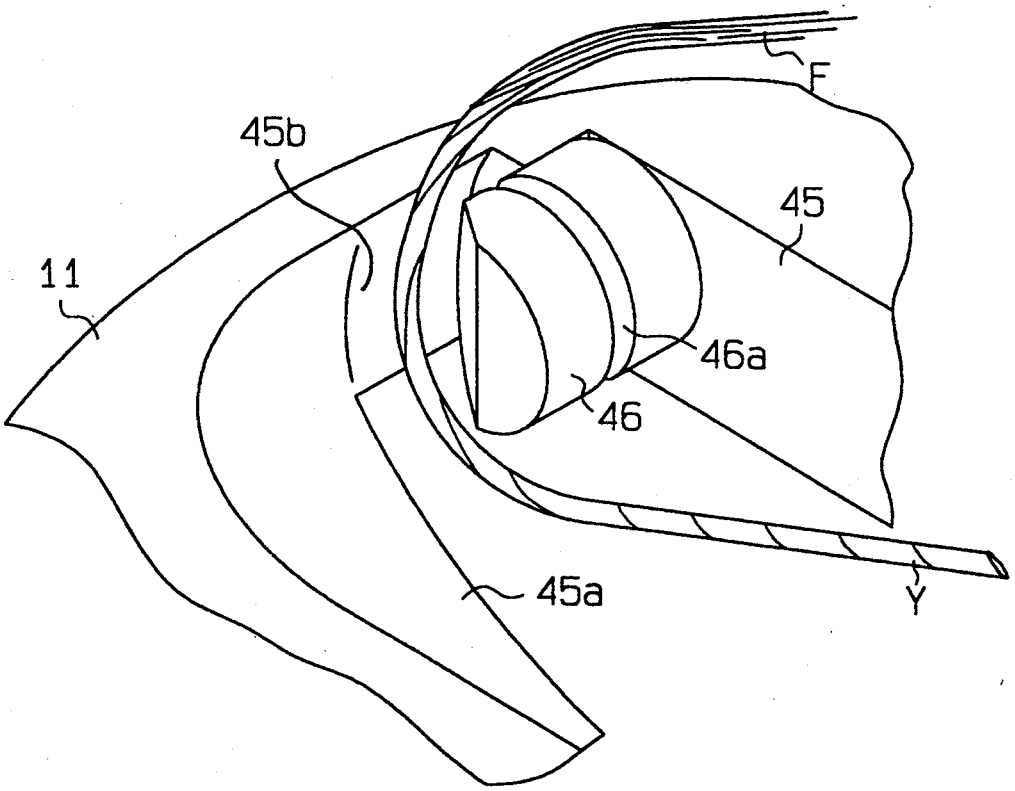
FIG. 20 is a schematic perspective view corresponding to FIG. 17B.
Figure 21:
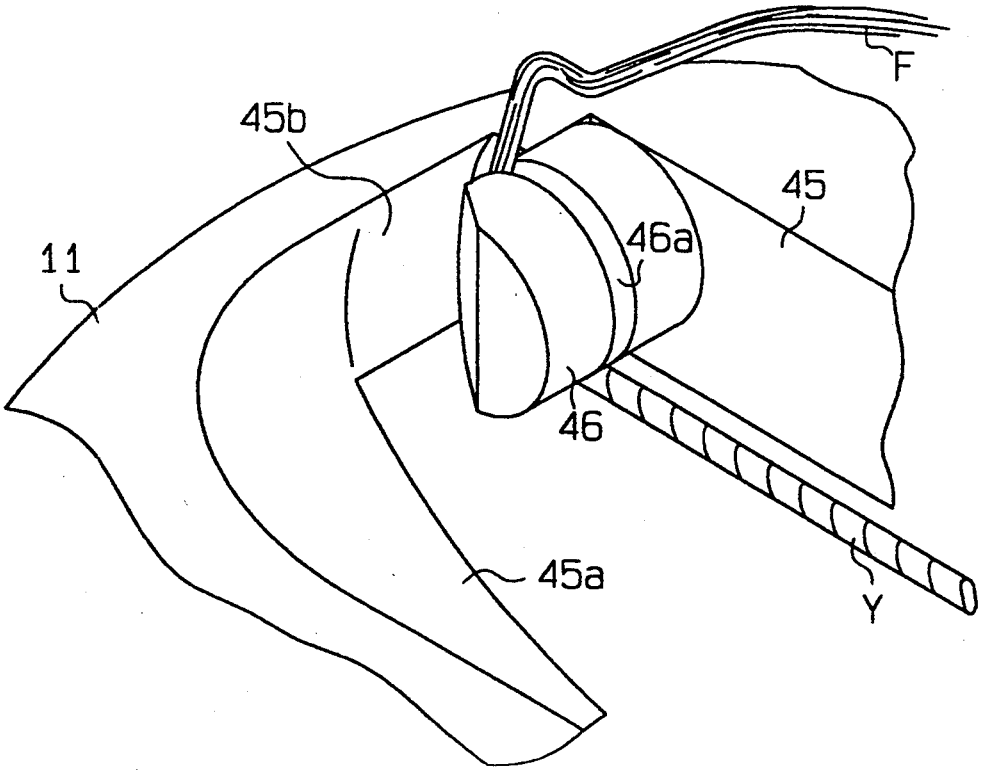
FIG. 21 is a schematic perspective view corresponding to FIG. 18.

Then, spinning is conducted in such a way that the fiber bundle F is guided to the naval 27 via the recess 45 of the inner rotor 11 with the yarn Y not engaged with the pin 46 at the initial stage of the yarn ending, as shown in FIGS. 17A and 19. Then, the rotational speed of the inner rotor 11 is set slower than the speed of separation of the fiber bundle F. As a result, the position of the separation point P of the fiber bundle F relatively moves to the front side of the rotational direction of the inner rotor 11 from the position in FIG. 17A, and the fiber bundle F (yarn Y) also moves in the same direction. As the centrifugal force is acting on the fiber bundle F, the fiber bundle F which is being drawn along the walls of the outer rotor 6 and inner rotor 11 from the fiber collecting section 6*a* also moves while sliding on the walls when the fiber bundle F (yarn Y) moves. The fiber bundle F then comes between the pin 46 and the wall 45*b* of the recess 45 from the state shown in FIGS. 17B and 20, and engages with the groove 46*a* as shown in FIGS. 18 and 21. Thereafter, spinning is carried out with the fiber bundle F drawn while in engagement with the groove 46*a* of the pin 46 as shown in FIGS. 18 and 21. In FIGS. 17 and 18, the fiber collecting section 6*a* is indicated by the chain line.

The recess 45 serves as a yarn passage for introduction of the standard thread and a drawing yarn passage to guide the fiber bundle F, drawn from the fiber collecting section 6*a*, to the position facing the yarn drawing passage 26 at the time of normal spinning. As that portion of the recess 45 on the first end portion side of the inner rotor 11 is shaped in such a way that the diameter of the opening edge is larger than that of the bottom side, the centrifugal force helps guide the fiber bundle F to between the pin 46 and the wall 45*b* at the time the fiber bundle F moves to the normal spinning position in yarn ending mode.

Fifth Embodiment

Figure 22:
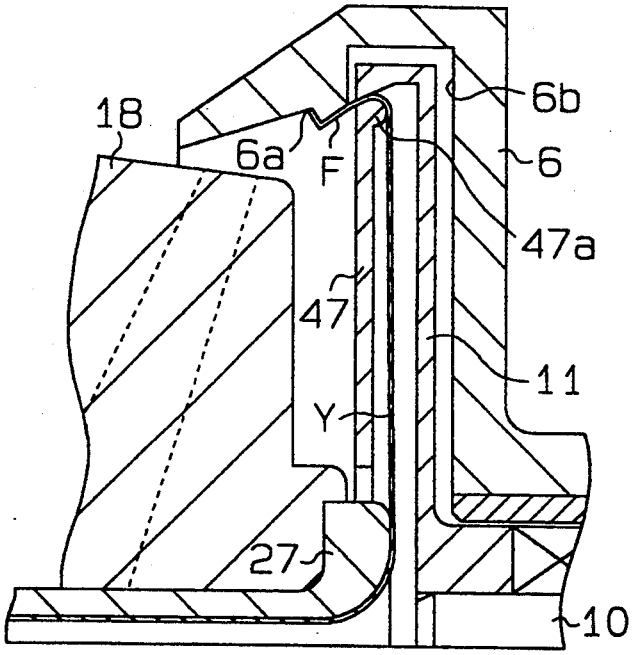
FIG. 22 is a partly cross-sectional view showing the normal spinning state of a spinning frame according to a fifth embodiment.
Figure 23:
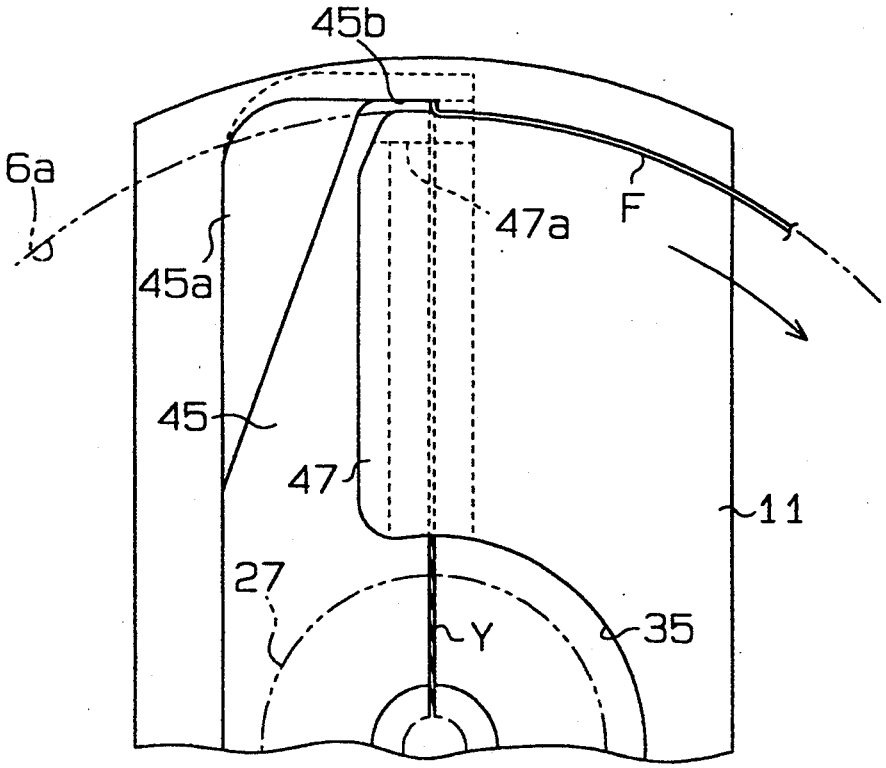
FIG. 23 is a schematic diagram of an inner rotor at the time of normal spinning as viewed from the entrance side of an outer rotor.

A fifth embodiment of the present invention will now be described referring to FIGS. 22 and 23. This embodiment differs from the fourth embodiment in the structure of the restriction means, and the other structure is the same. In this embodiment, a wall 47 for partitioning part of the yarn drawing passage from the space on the outer rotor 6 side is so formed as to protrude from the frontward wall of the recess 45 in the rotational direction of the inner rotor 11 while covering part of the yarn drawing passage. A gap formed between the wall 45*b* and the first end portion of the wall 47 is slightly narrower than the diameter of yarn to be spun. A semicolumnar engaging section 47*a* as restriction means is formed at the first end portion of the wall 47, close to the first end portion of the inner rotor 11.

In the spinning frame of this embodiment, in normal spinning mode, the fiber bundle F collected at the fiber collecting section 6*a* is drawn therefrom toward the inner rotor 11 along the wall of the outer rotor 6. Then, the fiber bundle F passes between the wall 45*b* and the surface of the engaging section 47*a* and changes its drawing direction toward the naval 27 at the position of the engaging section 47*a*. The fiber bundle F is drawn as yarn Y while being twisted by the rotation of the inner rotor 11. Because the clearance between the engaging section 47*a* and the wall 45*b* is narrow, the rotation of the fiber bundle F is suppressed at that portion. That is, the rotation of the yarn Y and fiber bundle F, drawn while being twisted, is suppressed from propagating to the fiber bundle F located upstream of the position corresponding to the engaging section 47*a*.

This embodiment therefore has the same action and advantages as the fourth embodiment, and carries out yarn ending in the same procedures as the fourth embodiment.

Sixth Embodiment

Figure 24:
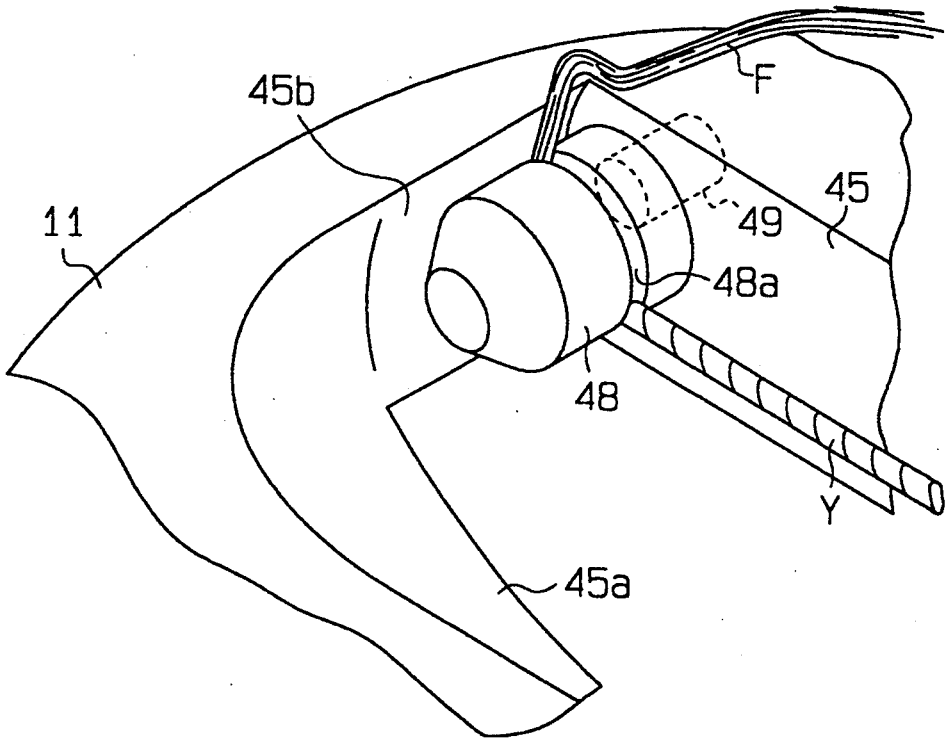
FIG. 24 is a partly schematic perspective view showing the normal spinning state of a spinning frame according to a sixth embodiment.

A sixth embodiment of the present invention will now be described referring to FIGS. 24 and 25. This embodiment differs from the fourth embodiment in the structure of the restriction means, and the other structure is the same. More specifically, the difference lies in that instead of protrusively providing the pin 46 at a predetermined position, the pin is provided rotatable so that the center of the pin is eccentric to the rotational center of the pin. A pin 48 is formed to have its distal end side shaped into a truncated cone, with a shaft 49 projecting from the proximal end of the pin 48 at the position eccentric to the center thereof. The shaft 49 is supported rotatable on a bearing retained in a retaining hole (neither shown) formed in the wall of the recess 45. A groove 48*a* is formed in the pin 48 close to the proximal end.

Figure 25:
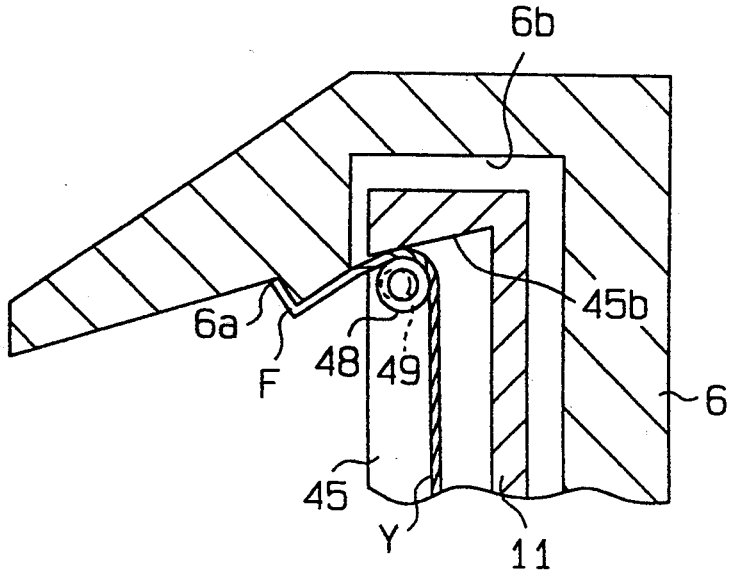
FIG. 25 is a partly enlarged cross-sectional view.

The position of the shaft 49 is determined in such a way that with the pin 48 abutting on the wall 45*b* of the recess 45, the centrifugal force acting on the pin 48 when the inner rotor 11 rotates, urges the pin 48 in the direction opposite to the drawing direction of the fiber bundle F (i.e., in the counterclockwise direction in FIG. 25).

In this embodiment, in normal spinning mode, the fiber bundle F is drawn via the navel 27 while in engagement with the groove 48*a* of the pin 48 like the fourth embodiment. The center of the pin 48 is eccentric to the rotational center thereof or the center of the shaft 49, and the center of the shaft 49 is positioned closer to the opening side of the recess 45 than the center of the pin 48 at the spinning time as shown in FIG. 25. As a result, the centrifugal force acting on the pin 48 when the inner rotor 11 rotates, causes the pin 48 to rotate counterclockwise in FIG. 25 around the shaft 49. In other words, force to push the fiber bundle F against the wall 45*b* always acts on the pin 48 during spinning, so that twisting of the fiber bundle F is stopped at that position. As the pin 48 is rotatable around the shaft 49, even if the thickness of the fiber bundle F varies slightly, the pin 48 rotates around the shaft 49 accordingly, thus preventing excessive force from acting on the fiber bundle F. Unlike in the fourth embodiment, it is unnecessary to adjust the gap between the pin 48 and the wall 45*b* in accordance with a change in the thickness of spinning yarn caused by a change in spinning conditions.

Seventh Embodiment

Figure 26:
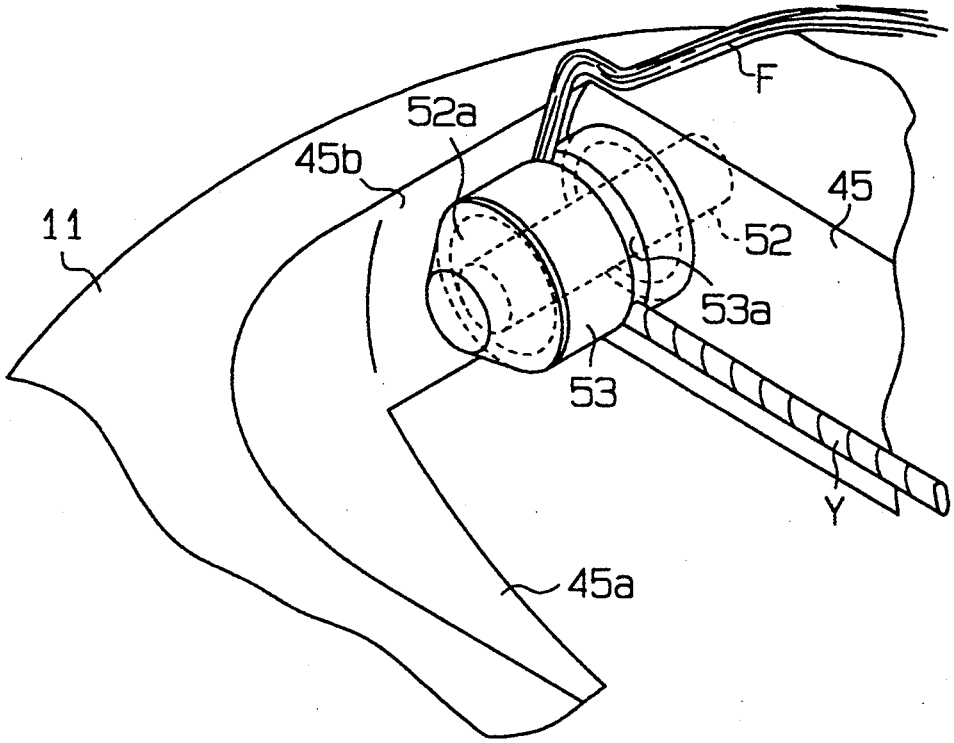
FIG. 26 is a partly schematic perspective view showing the normal spinning state of a spinning frame according to a seventh embodiment.
Figure 27:
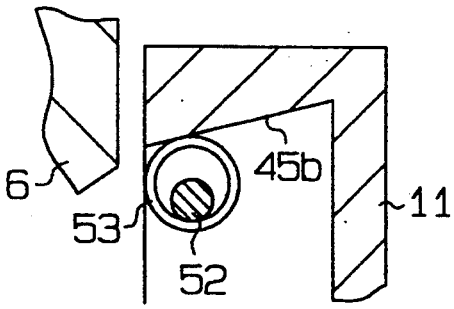
FIG. 27 is a partly enlarged cross-sectional view at the non-spinning time.
Figure 28:
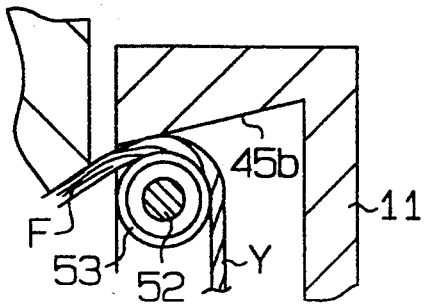
FIG. 28 is a partly enlarged cross-sectional view at the time of normal spinning.
Figure 29:
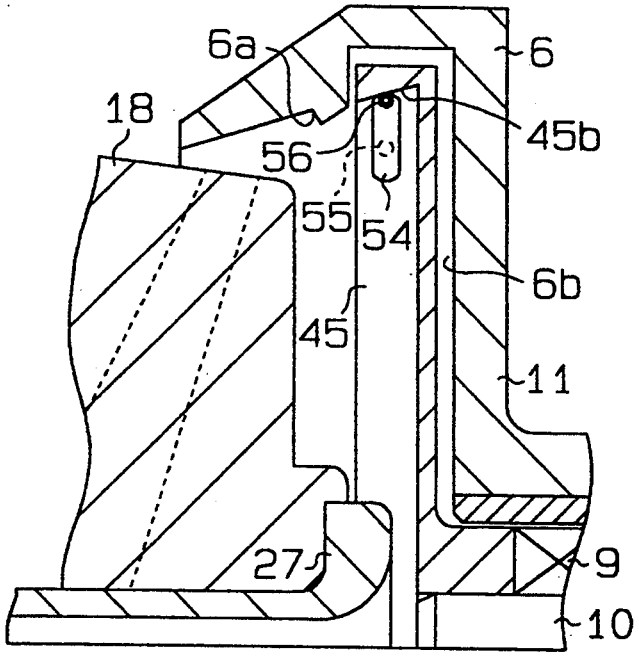
FIG. 29 is a partly cross-sectional view of a spinning frame according to an eighth embodiment at the non-spinning time.
Figure 30:
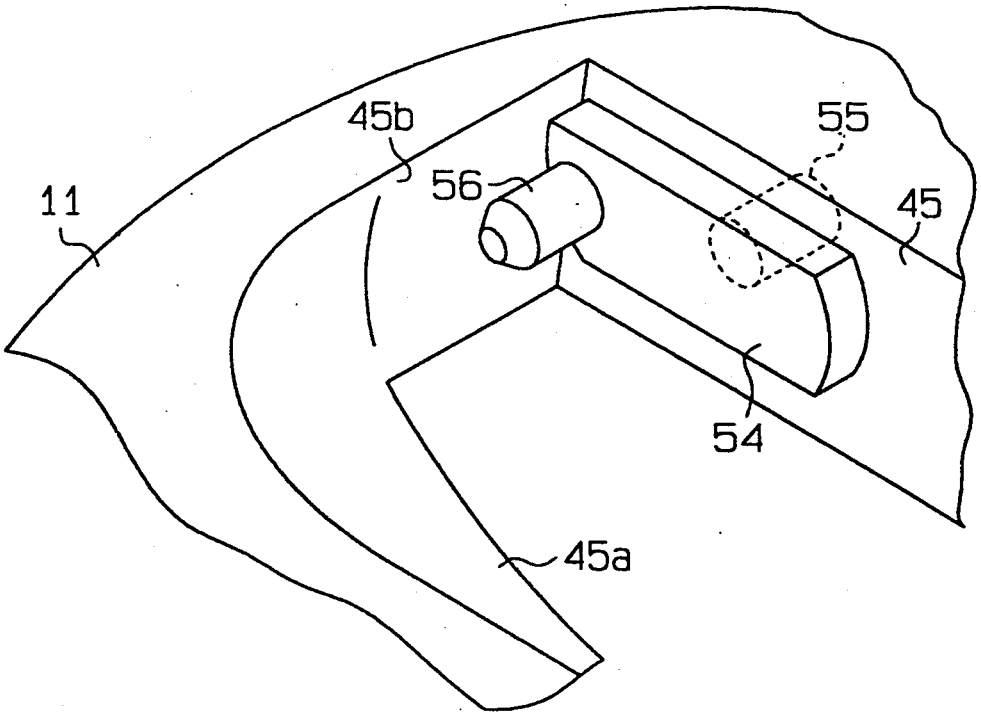
FIG. 30 is a partly schematic cross-sectional view corresponding to FIG. 29.

A seventh embodiment of the present invention will now be described referring to FIGS. 26 through 28. This embodiment differs from the sixth embodiment in the structure of the restrictions means, and the other structure is the same. The restriction means is constituted of a support shaft 52 and a cylinder 53 which is loosely fitted on the support shaft 52, instead of the pin 48 provided rotatably. As shown in FIG. 26, the support shaft 52 is protrusively provided on the wall of the recess 45, with a cone-shaped guide section 52*a* formed at its distal end. A groove 53*a* is formed in the outer surface of the cylinder 53. As shown in FIG. 27, the cylinder 53 has its outer surface abuttable on the wall 45*b* with the inner surface engaged with the support shaft 52.

With the structure of this embodiment, if the fiber bundle F is not present between the cylinder 53 and the wall 45*b* with the inner rotor 11 rotating, the centrifugal force causes the outer surface of the cylinder 53 to abut on the wall 45*b* and causes the inner surface to abut on the support shaft 52. At the time of spinning, the fiber bundle F comes between the cylinder 53 and the wall 45*b* as shown in FIG. 28, and is pressed against the wall 45*b* by the cylinder 53 so that twisting is stopped there.

In this embodiment, the cylinder 53 is movable more freely than the pin 48 of the sixth embodiment, and can thus follow up a change in the thickness of the fiber bundle F more easily.

Eighth Embodiment

Figure 31:
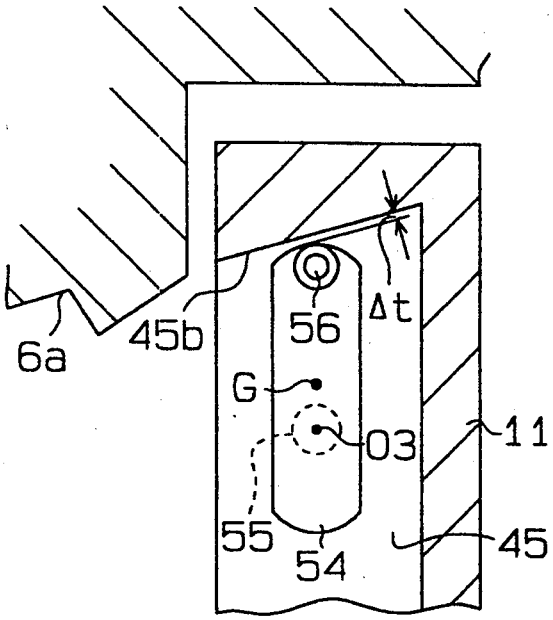
FIG. 31A is an exemplary diagram showing the relationship between a support lever and a wall at the non-spinning time.
FIG. 31B is an exemplary diagram showing the relationship between the support lever and the wall at the spinning time.
Figure 31:
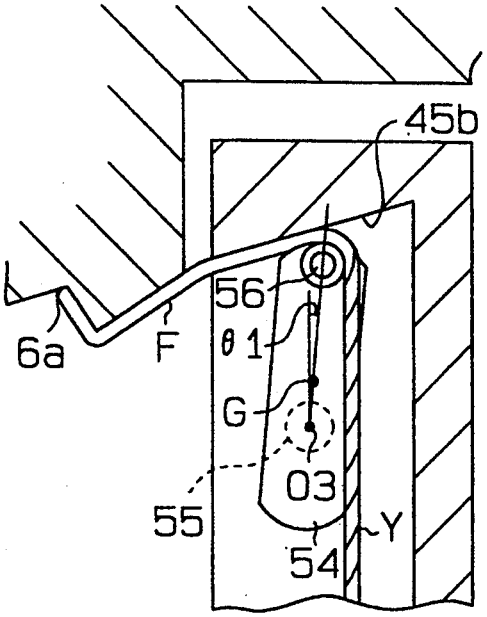

An eighth embodiment of the present invention will now be described referring to FIGS. 29 through 34. This embodiment differs from the sixth embodiment in the structure of the restriction means, and the other structure is the same. A support lever 54 is provided movable in the recess 45. A support shaft 55 is protrusively provided on the support lever 54, and is rotatably supported on a bearing provided on the wall of the recess 45. A pin 56 is provided projecting from the distal end of the support lever 54. As shown in FIG. 31A, the center of gravity G of the support lever 54 is closer to the pin 56 than its rotational center O3.

As shown in FIG. 31A, the position of the support shaft 55 is determined in such a way that with the support lever 54 positioned to set the center of gravity G and the rotational center O3 on a plane parallel to a plane containing the fiber collecting section 6*a*, there is a clearance $\Delta t$ between the wall 45*b* and the pin 56. The clearance $\Delta t$ is set smaller than the thickness of yarn to be spun. The pin 56 can come close to or away from the wall 45*b* in accordance with the rotation of the support lever 54.

Figure 32:
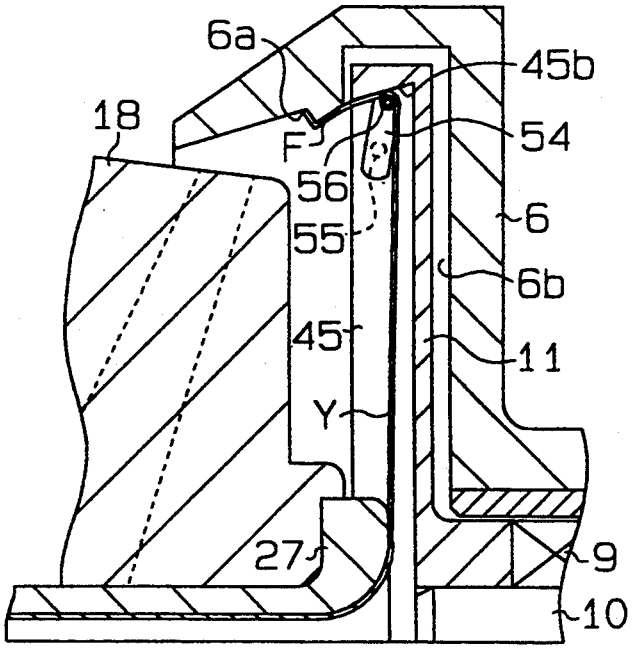
FIG. 32 is a partly cross-sectional view at the time of normal spinning.
Figure 33:
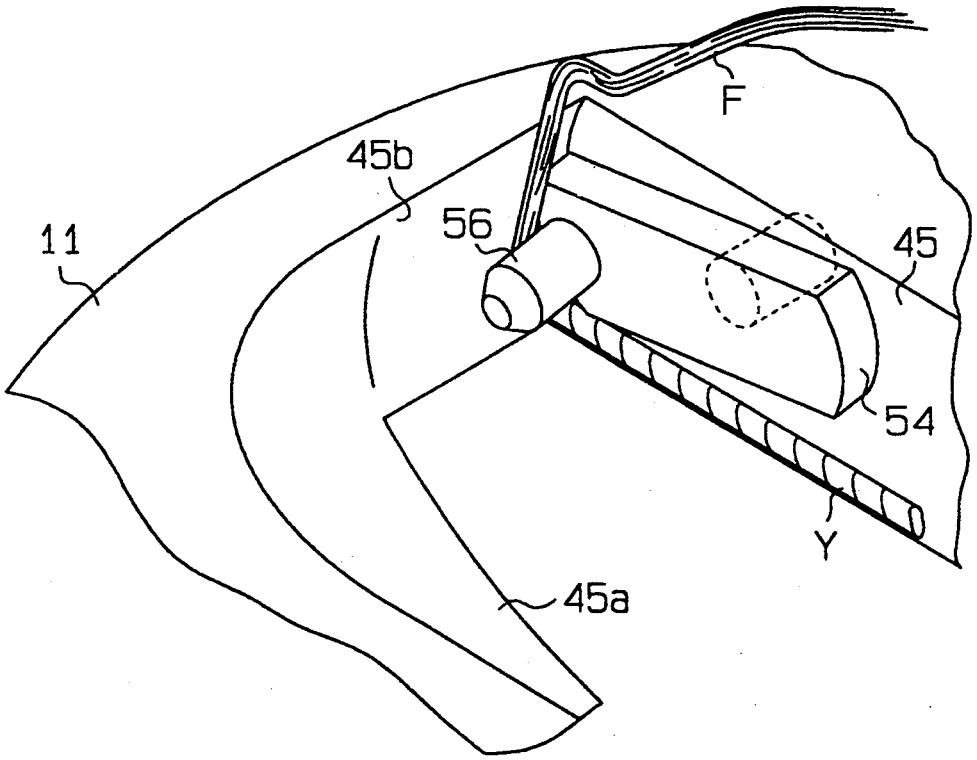
FIG. 33 is a partly schematic perspective view corresponding to FIG. 32.
Figure 34:
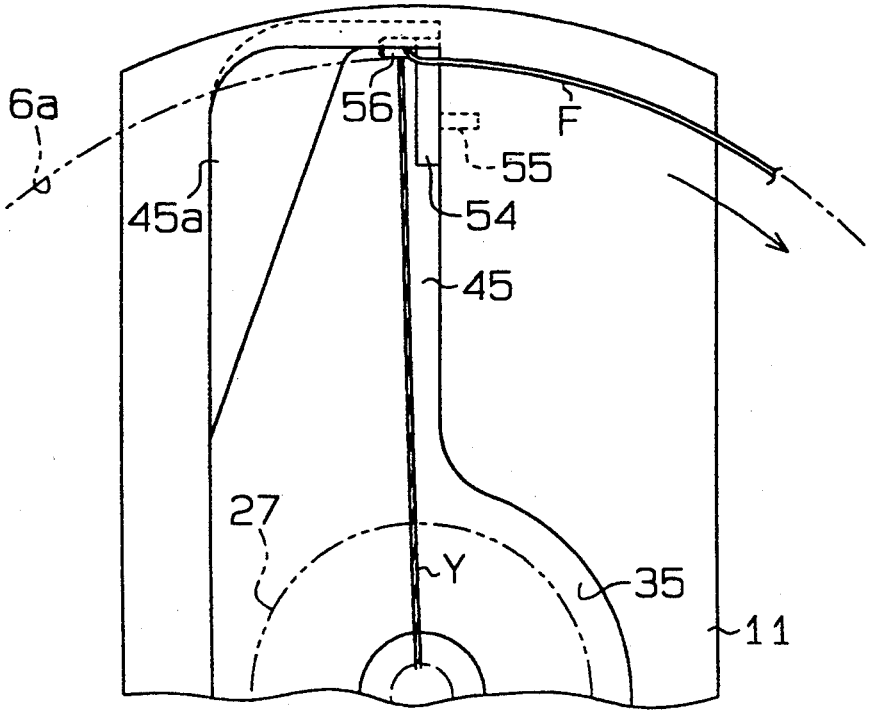
FIG. 34 is a schematic diagram of an inner rotor at the time of normal spinning as viewed from the entrance side of an outer rotor.

As shown in FIGS. 32 and 33, at the spinning time, the support lever 54 is rotated in the drawing direction of the fiber bundle F by the force that draws the fiber bundle F, widening the clearance between the pin 56 and the wall 45*b*. During the rotation of the inner rotor 11, centrifugal force acts to set the support lever 54 to the position (reference position) in FIGS. 29 to 31, and this force causes the pin 56 to press the fiber bundle F against the wall 45*b*. With a constant rotational speed of the inner rotor 11, this pressure is a function of the rotational angle $\Theta 1$ from the reference position, the distance between the center of gravity G and the rotational center O3 and the distance between the rotational center O3 and the center of the pin 56 shown in FIG. 31B. The distance between the center of gravity G and the rotational center O3 and the distance between the rotational center O3 and the center of the pin 56 are determined by the shape of the support lever 54. By properly choosing the shape of the support lever 54, spinning is carried out with the desired pressure applied to the fiber bundle F.

With the clearance set to $\Delta t \approx 0$, it is unnecessary to set the clearance $\Delta t$ in accordance with the thickness of yarn to be spun. The structure of this embodiment ensures easier adjustment of the pressure acting on the fiber bundle F than the sixth and seventh embodiments.

Ninth Embodiment

A ninth embodiment of the present invention will now be described referring to FIGS. 35 through 38. This embodiment differs from the individual embodiments discussed in the foregoing description in that at the time of yarn ending, after the fiber bundle F is drawn toward the center of the outer rotor 6 directly from the fiber collecting section 6*a* outside the inner rotor 11, the fiber bundle F is allowed to pass inside the inner rotor 11.

Figure 37:
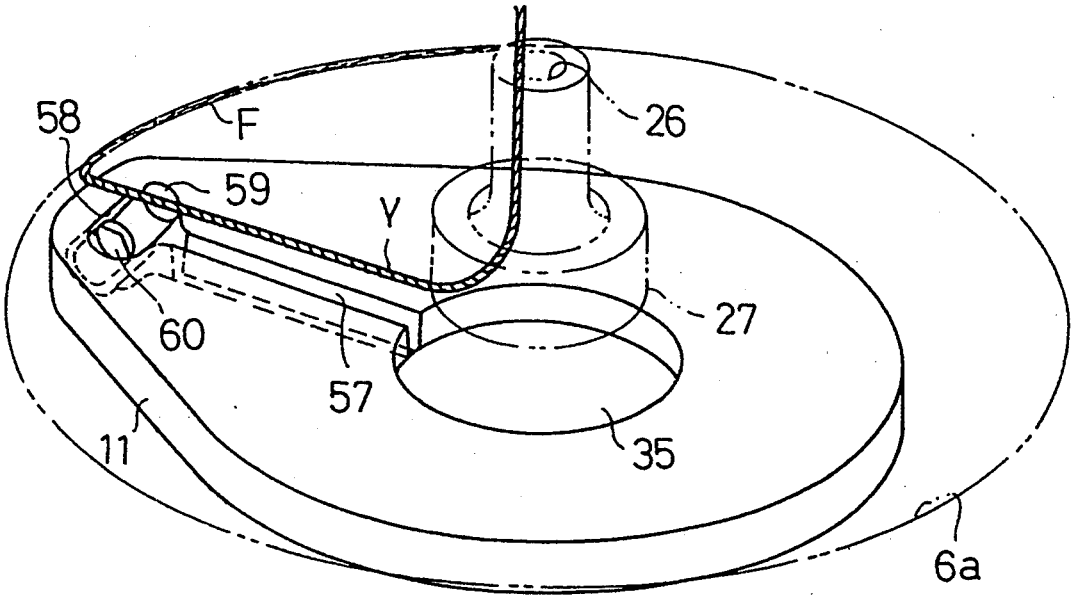
FIG. 37 is a schematic perspective view at the time of yarn ending.
Figure 38:
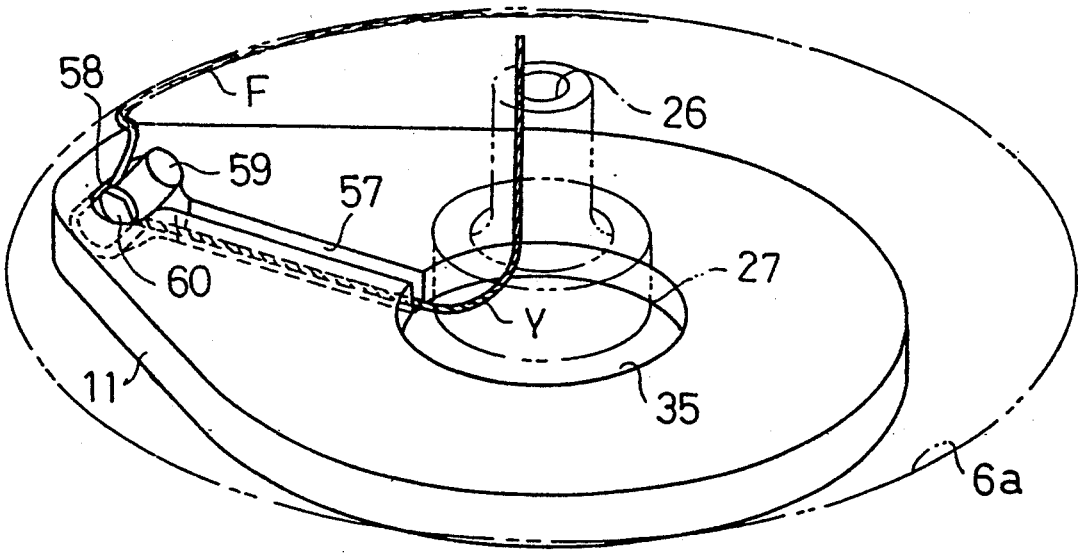
FIG. 38 is a schematic perspective view at the time of normal spinning.

As shown in FIGS. 37 and 38, like in the first to third embodiments, the inner rotor 11 is so formed that the first end portion is made narrower, and a yarn passage 57 stretching to the recess 35 is formed to be open to the opening side of the outer rotor 6. A retaining recess 58 is formed at the position corresponding to the first end portion of the yarn passage 57, stretching outward from both sides of the yarn passage 57, with a set of rollers 59 and 60 provided rotatable in the recess 58. The rollers 59 and 60 are arranged parallel to each other with a gap narrower than the thickness of spinning yarn, with their distal end sides slanted toward the inside of the inner rotor 11. The roller 59 located frontward in the rotational direction of the inner rotor 11 has such a length to protrude outside the recess 58. The roller 60 located rearward in the rotational direction of the inner rotor 11 has such a length not to protrude outside the recess 58 and has a cone-shaped distal end. Both rollers 59 and 60 constitute twist stopping means.

Figure 35:
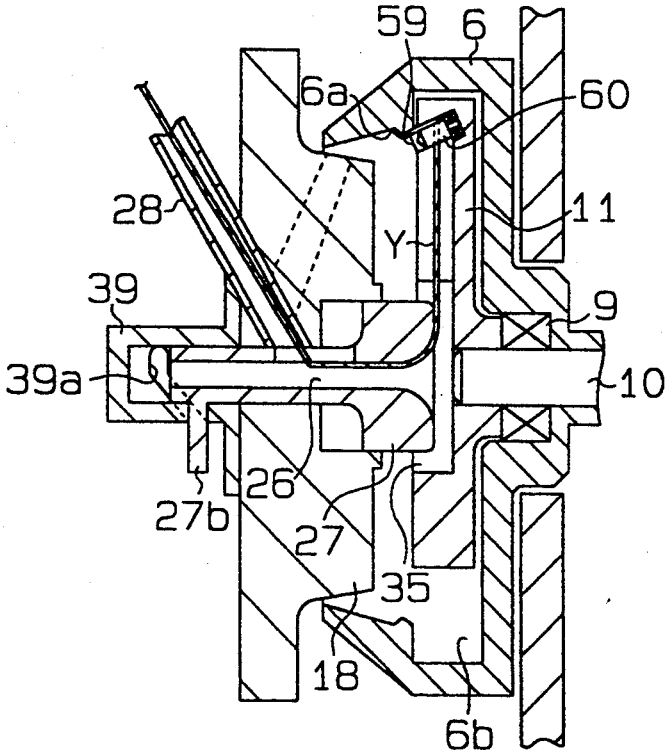
FIG. 35 is a partly cross-sectional view of a spinning frame according to a ninth embodiment at the normal spinning state.

The navel 27 is designed movable in the axial direction of the inner rotor 11 by the activation of a rotary solenoid (not shown) as in the second embodiment. The navel 27 is positioned at the spinning position where its distal end comes inside the recess 35 in normal spinning mode as shown in FIGS. 35 and 38. In this state, the fiber bundle F collected at the fiber collecting section 6*a* is drawn therefrom toward the inner rotor 11 along the wall of the outer rotor 6 as in the fourth to eighth embodiments. Then, the fiber bundle F is wound around the roller 59, changing its drawing direction toward the navel 27, and is drawn as yarn Y while being twisted by the rotation of the inner rotor 11. Because the gap between both rollers 59 and 60 is narrower than the thickness of the spinning yarn, the rotation of the fiber bundle F is suppressed there. That is, the rotation of the yarn Y and fiber bundle F, drawn while being twisted, is suppressed from propagating to the fiber bundle F located upstream of the position corresponding to both rollers 59 and 60.

Figure 36:
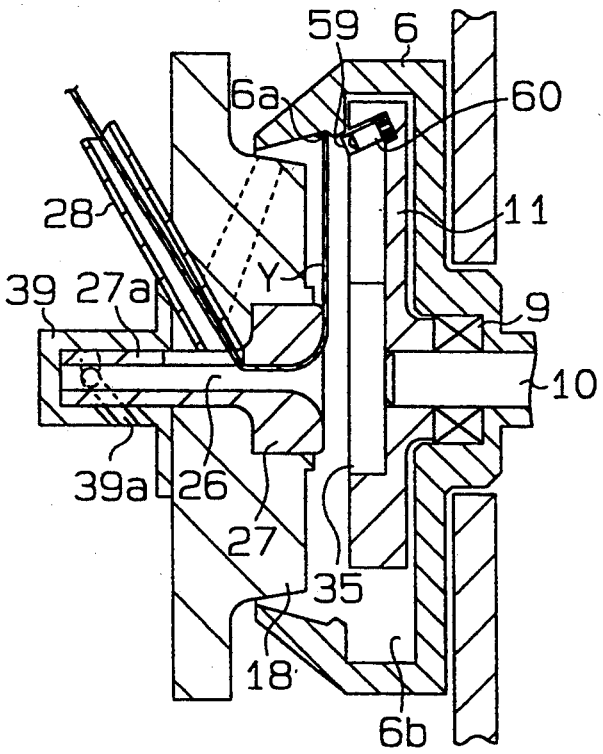
FIG. 36 is a partly cross-sectional view at the time of yarn ending.

At the time of yarn ending, the navel 27 is disengaged from the recess 35 and comes to the position where its distal end lies on the same plane as the fiber collecting section 6*a* as shown in FIGS. 36 and 37. With the outer rotor 6 and inner rotor 11 rotating, the supply of the compressed air to the ejector 29 is stopped, as in the fourth to eighth embodiments. Under this condition, the standard thread is inserted into the yarn drawing passage 26 from the yarn pipe 28. The standard thread moves toward the inner wall of the outer rotor 6 by the air stream flowing inside the outer rotor 6 from the yarn drawing passage 26. After the distal end of the standard thread reaches the inner wall of the outer rotor 6 at the position closer to the opening side of the outer rotor 6 than the fiber collecting section 6*a*, it slides along that inner wall to reach the fiber collecting section 6*a*.

Then, the standard thread is drawn by the forward rotation of the drawing roller (not shown), and the fiber bundle F collected at the fiber collecting section 6*a* is wound around the end portion of the standard thread and is separated from the fiber collecting section 6*a* to be drawn together with the standard thread. Spinning is performed while the yarn Y is drawn from the navel 27 without going through the inner rotor 11 at the initial stage of the yarn ending as shown in FIGS. 36 and 37.

Then, the navel 27 is moved in the axial direction and is disposed at the spinning position at which its distal end is loosely fitted in the recess 35 and comes on the opposite side to the opening end of the outer rotor 6 from the plane where the fiber collecting section 6*a* lies, an shown in FIGS. 35 and 38. The yarn Y moves toward the yarn passage 57 in accordance with the movement of the navel 27. By the time the movement of the navel 27 is completed, as shown in FIGS. 35 and 38, the fiber bundle F separated from the fiber collecting section 6*a* has moved through the yarn passage 57 while contacting both rollers 59 and 60, to be ready to be drawn out of the yarn drawing passage 26. In this embodiment, therefore, the navel 27 constitutes restriction means to restrict the movement of the fiber bundle F, introduced in the yarn passage 57.

After the navel 27 is moved to the spinning position where it is loosely fitted in the recess 35, when the rotational speed of the inner rotor 11 is set lower than the speed of separation of the fiber bundle F, the separation point of the fiber bundle F relatively moves frontward in the rotational direction of the inner rotor 11. Even if the yarn Y is located off the yarn passage 57 when the navel 27 is moved to the spinning position, the above operation causes the yarn Y to shift to the position corresponding to the yarn passage 57. After engaging with the roller 59, the yarn Y is guided into the gap between the rollers 59 and 60.

Tenth Embodiment

Figure 39A:
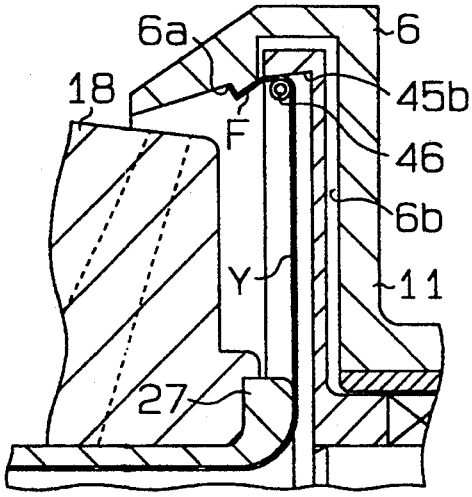
FIG. 39A is a partly cross-sectional view of a spinning frame according to a tenth embodiment at the normal spinning state.

A tenth embodiment of the present invention will now be described referring to FIG. 39. This embodiment differs from the fourth to eighth embodiments in that the wall 45*b* of the recess 45 formed in the inner rotor 11 is almost parallel to the axial direction of the inner rotor 11 and that the diameter up to the wall 45*b* is set nearly the same as the diameter of the fiber collecting section 6*a*. In the spinning frame as shown in FIG. 39A, the inclination of the wall of the outer rotor 6 extending toward the retaining section 6*b* from the fiber collecting section 6*a* is smaller than that in the individual embodiments described above, and the fiber bundle F, which is drawn from the fiber collecting section 6*a* and moves along the wall of the outer rotor 6 and the wall 45*b* of the inner rotor 11, is drawn nearly horizontally toward the pin 46.

Figure 39B:
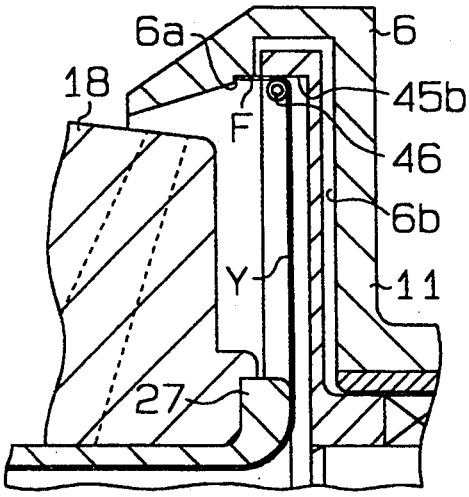
FIG. 39B is a partly cross-sectional view of a spinning frame according to a modification of the tenth embodiment.

In the spinning frame as shown in FIG. 39B, the wall of the outer rotor 6 extending toward the retaining section 6*b* from the fiber collecting section 6*a* is formed nearly parallel to the axial direction of the outer rotor 6. The wall 45*b* of the inner rotor 11 is likewise formed to lie on a line extending from the wall of the outer rotor 6.

In either case, the tension applied to the fiber bundle F when the fiber bundle F moves to the position corresponding to the pin 46, becomes smaller than that in the case where the fiber bundle F is drawn toward the center of the outer rotor 6 directly from the fiber collecting section 6*a*.

Eleventh Embodiment

Figure 40A:
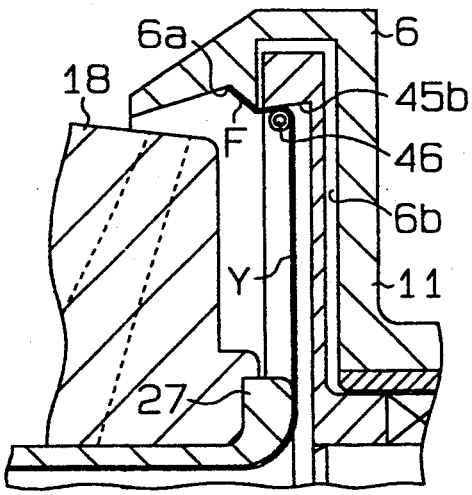
FIG. 40A is a partly cross-sectional view of a spinning frame according to an eleventh embodiment at the normal spinning state.
Figure 40B:
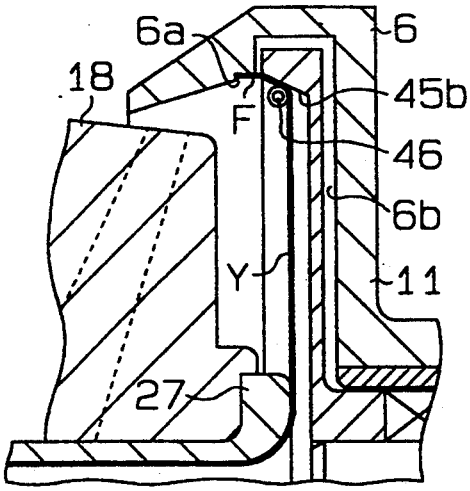
FIG. 40B is a partly cross-sectional view of a spinning frame according to a modification of the eleventh embodiment.

An eleventh embodiment of the present invention will now be described referring to FIG. 40. This embodiment differs from the tenth embodiment in that the distance from the center of the inner rotor 11 up to the restriction means which is provided on the inner rotor 11 to stop twisting is smaller than the radius of the fiber collecting section 6*a*. In the spinning frame as shown in FIG. 40A, the wall of the outer rotor 6 extending toward the retaining section 6*b* from the fiber collecting section 6*a* is formed to extend inward. The wall 45*b* is formed to extend almost in parallel to the axial direction of the inner rotor 11 from the position corresponding to the opening edge of the retaining section 6*b*. In the spinning frame as shown in FIG. 40B, the wall of the outer rotor 6 extending toward the retaining section 6*b* from the fiber collecting section 6*a* is formed nearly parallel to the axial direction of the outer rotor 6. The wall 45*b* of the inner rotor 11 is formed to extend inward.

In this embodiment also, the tension applied to the fiber bundle F when the fiber bundle F moves to the position corresponding to the pin 46, becomes smaller than that in the case where the fiber bundle F is drawn toward the center of the outer rotor 6 directly from the fiber collecting section 6*a*. As the pin 46 is positioned inward of the fiber collecting section 6*a* in this embodiment, the largest outside diameter of the inner rotor 11 can be set about the same as the diameter of the fiber collecting section 6*a*. Therefore, the outside diameter of the outer rotor 6 can be set about the same as the one in the first to third embodiments in which the fiber bundle F is drawn toward the center of the outer rotor 6 directly from the fiber collecting section 6*a*.

Figure 41:
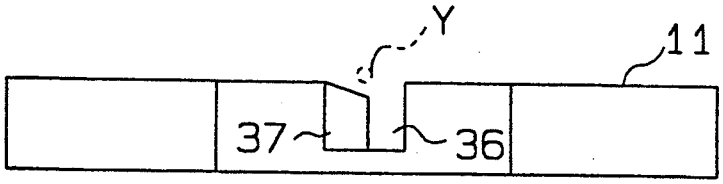
FIG. 41 is a schematic diagram showing a modification of the inner rotor as viewed from the entrance side of a yarn passage.
Figure 42:
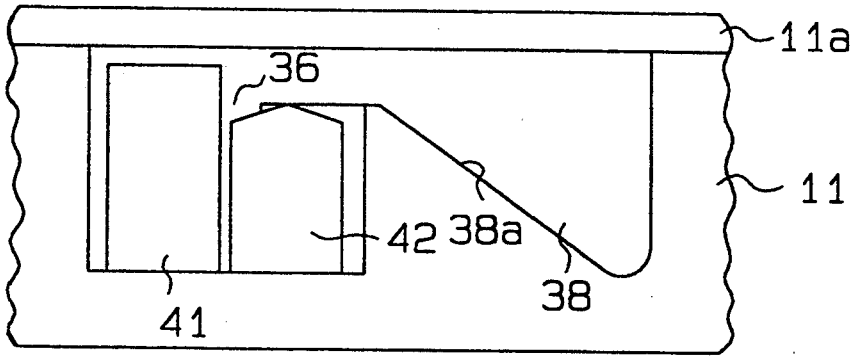
FIG. 42 is a schematic diagram, with portions omitted, showing a modification of the inner rotor having contact members as viewed from the entrance side of the yarn passage.

The present invention is not limited to the above-described embodiments, but may be modified in various other forms without departing from the spirit or scope of the invention. For instance, the introduce passage 38 in the second embodiment may be formed in such a manner that its opposite side to the yarn passage 36 is open as shown in FIG. 41. In the third embodiment, the distal end of the first contact member 41 may be formed to have a rough surface, or the distal end of the second contact member 42 may be formed to have a cone shape as shown in FIG. 42. This structure allows the yarn Y, introduced to the yarn passage 36 from the introduce passage 38, to come between both contact members 41 and 42 more easily.

Figure 43:
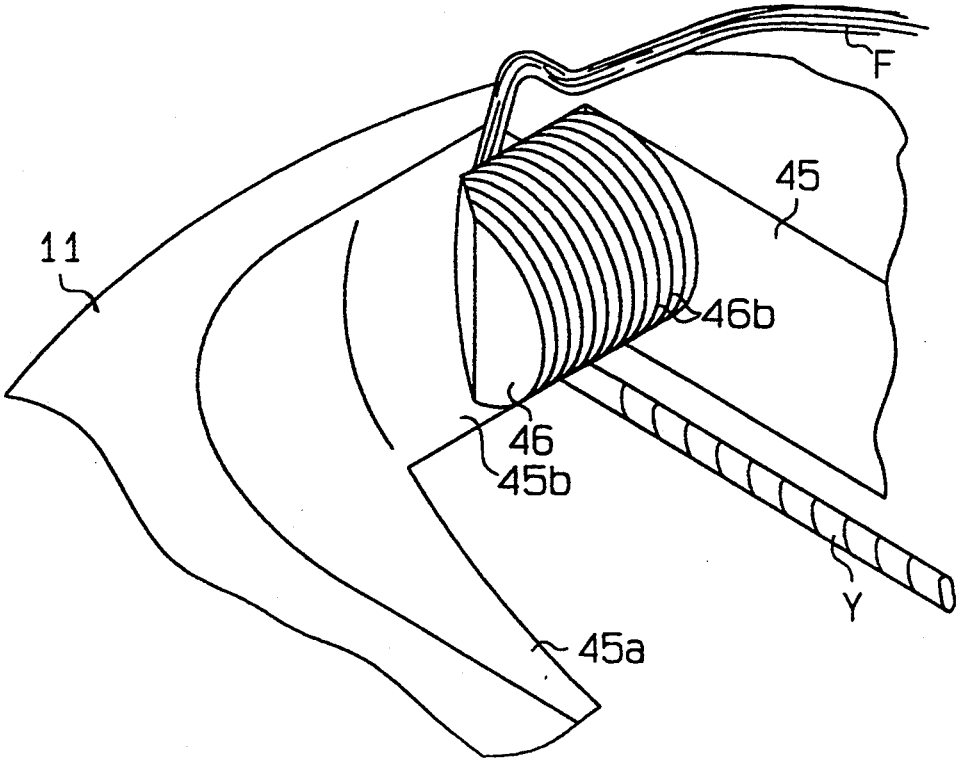
FIG. 43 is a schematic perspective view of a modification of the pin.
Figure 44:
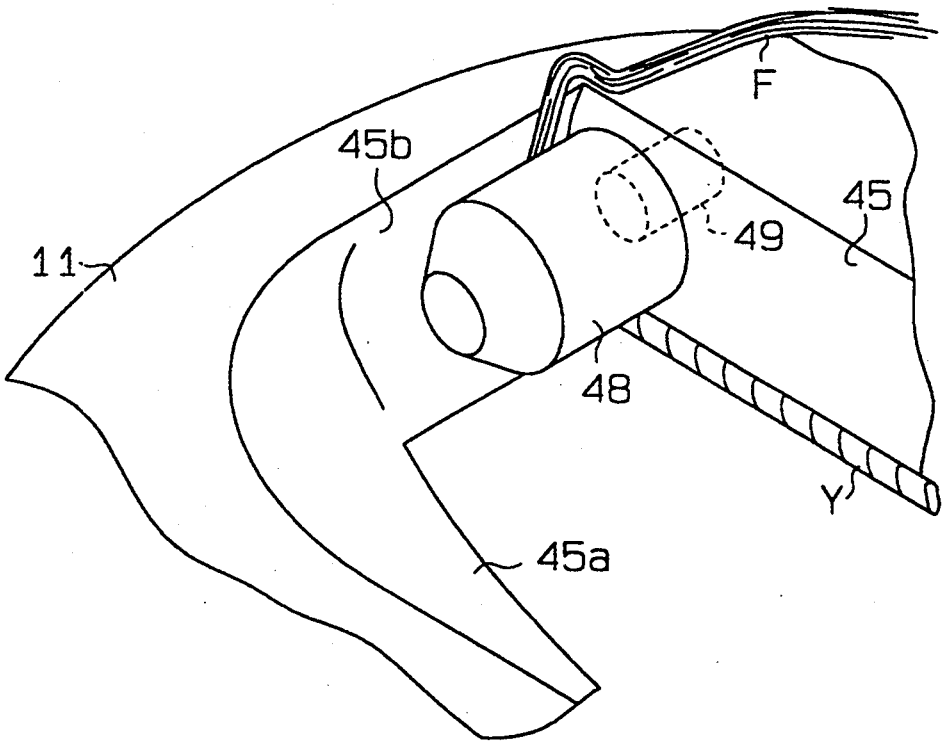
FIG. 44 is a schematic perspective view of another modification of the pin.
Figure 45:
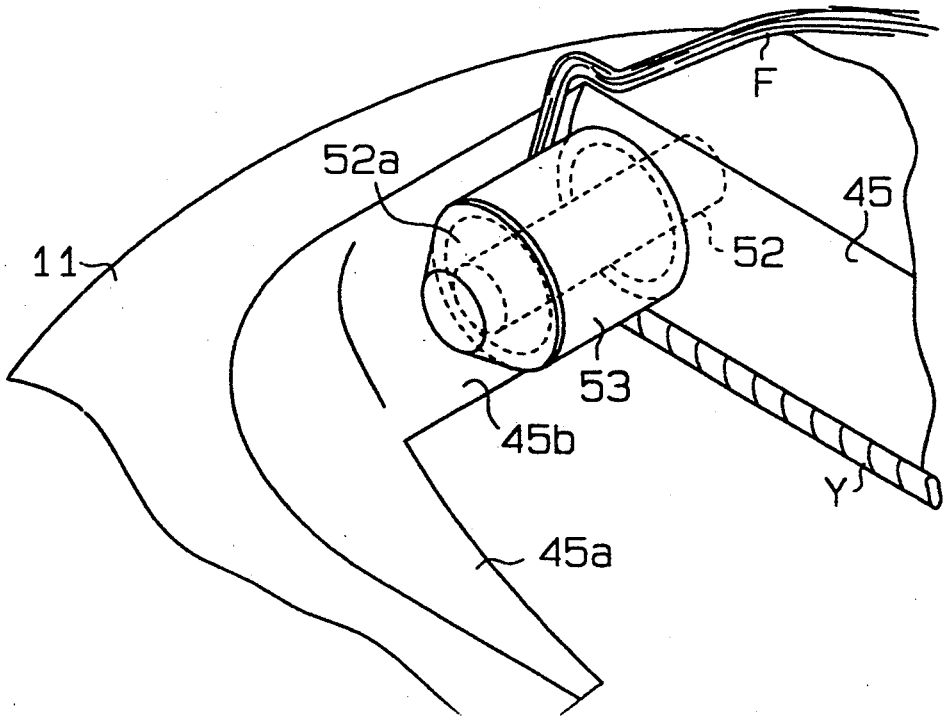
FIG. 45 is a schematic perspective view of a modification of restriction means.
Figure 46:
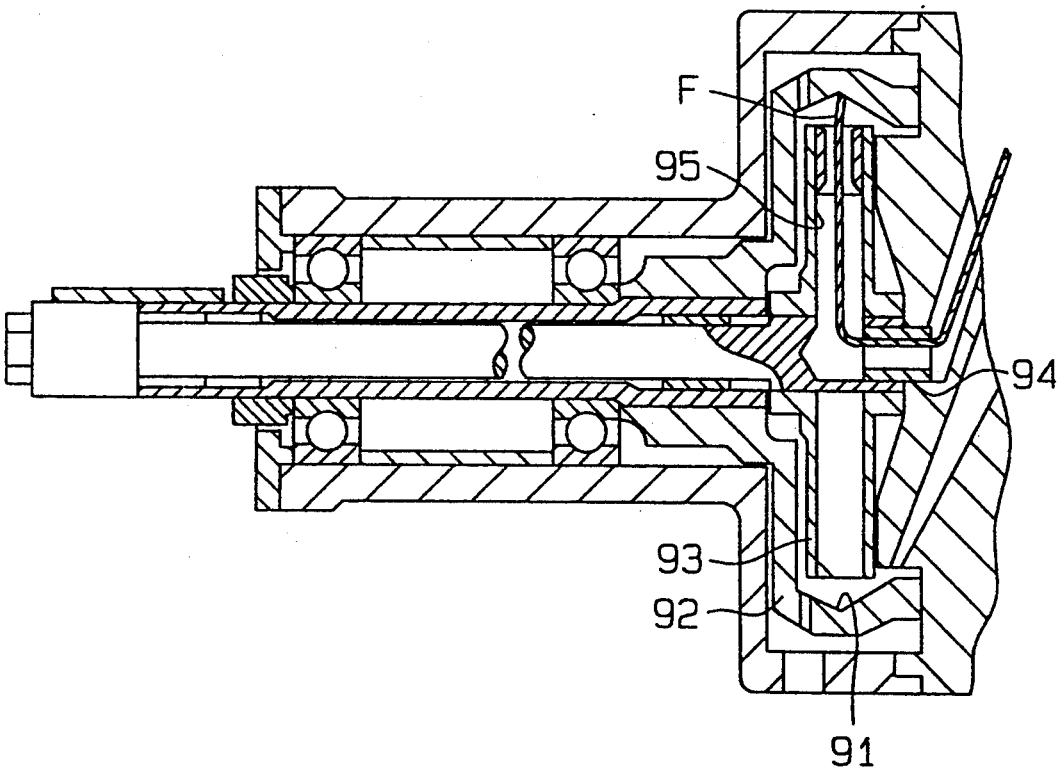
Fig. 46 (Prior Art)
FIG. 46 is a cross section of a conventional apparatus.

Further, the pin 46 in the fourth embodiment may be designed to have a number of stripes 46*b* formed on its outer surface in the circumferential direction as shown in FIG. 43. The pin 48 used in the sixth embodiment or the cylinder 53 used in the seventh embodiment may be modified to have no groove 48*a* or 53*a* on its surface as shown in FIG. 44 or 45. The restricting action and twist stopping function will work even without the groove 48*a* or 53*a*.

A curved leaf spring may be attached to the wall 47 in place of the engaging section 47*a* in the fifth embodiment. With the use of the leaf spring, when the thickness of spinning yarn varies, the leaf spring bends to prevent excessive pressure from acting on the fiber bundle F.

The twist propagation preventing portion may be omitted in the first to third embodiments. Further, other suction means than the ejector 29 may be connected as a negative pressure generator to the yarn pipe. Furthermore, the ejector 29 is not essential and may thus be omitted.

Figure 47:
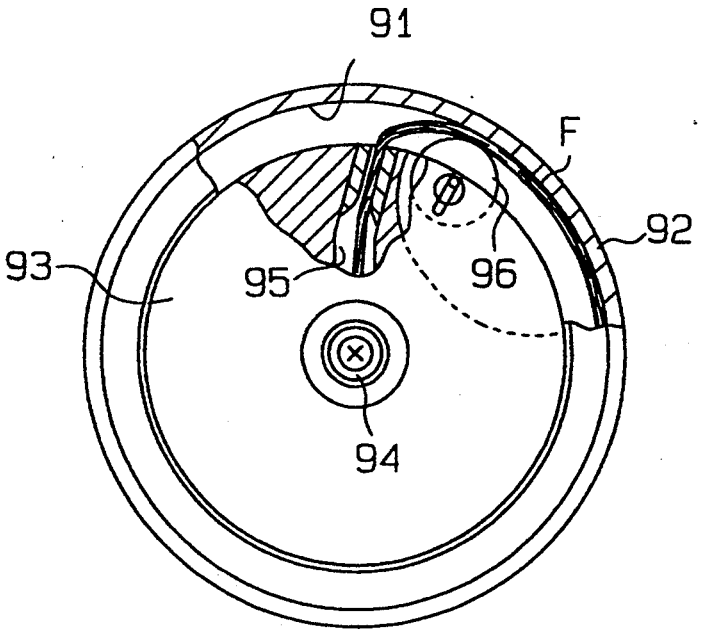
Fig. 47 (Prior Art)
FIG. 47 is a front view showing the relationship between an outer rotor and a draft rotor of the conventional apparatus, with parts broken away, as viewed from the opening side of the outer rotor.

The inner rotor may be designed to have a disk shape as shown in FIG. 47. The shape of pin is not limited to be linear, but may be curved.

What is claimed is:

1. A rotor type open-end spinning frame which spins a yarn from a fiber bundle formed from unraveled fibers at a fiber collecting section while applying a twist to said fiber bundle during normal spinning, and which pieces said fiber bundle to a standard thread supplied to said fiber collecting section during yarn piecing; said spinning frame comprising:

an outer rotatable rotor having an open end, a closed end and a peripheral wall, said peripheral wall including a fiber collecting section;

an inner rotor mounted for rotation within said outer rotor coaxially therewith, said inner rotor being rotatable independently of said outer rotor during both said normal spinning and said yarn piecing;

a conduit member arranged opposite said open end of said outer rotor for passing yarn therethrough to and from said rotors;

a first passage provided in said inner rotor for communicating with said conduit member to guide said fiber bundle from said fiber collecting section to said conduit member during normal yarn spinning;

a second passage provided in said inner rotor for communicating with said conduit member to introduce said standard thread from said conduit member into said fiber collecting section during yarn piecing; and restriction means provided in said inner rotor for retaining said fiber bundle at a predetermined position within said first passage by engaging said fiber bundle which has been drawn from said fiber collecting section during said yarn spinning.

2. A spinning frame according to claim 1, wherein said restriction means inhibits said twist from propagating to said fiber bundle in the fiber collecting section during spinning time, wherein said inner rotor is disposed close to said closed end of the outer rotor, and wherein said inner rotor has a guide surface that moves said fiber bundle, drawn by the standard thread which has been introduced into said second passage, toward said restriction means.

3. A spinning frame according to claim 2, wherein said inner rotor has a recess whose mouth faces said open end of said outer rotor, said recess having a covered portion including said first passage, second passage and restriction means.

4. A spinning frame according to claim 3, wherein said restriction means includes a pin.

5. The spinning frame according to claim 4, wherein said pin is movable, and a gap between said pin and a side wall of a portion of said recess is established that is smaller than the diameter of said fiber bundle.

6. The spinning frame according to claim 4, wherein said pin is provided in such a way as to have a rotational center eccentric to a center of said pin.

7. A spinning frame according to claim 3, wherein said inner rotor has a large radius portion, said large radius portion being disposed radially inwardly with respect to said fiber collecting section and supporting said restriction means.

8. The spinning frame according to claim 3, wherein said restriction means comprises a support lever provided rotatable around a support shaft substantially perpendicular to the lengthwise direction of said second passage, and a pin protrusively formed at a distal end of said support lever, the center of gravity of said support lever being established closer to said pin than to said support shaft, and a gap between said pin and a side wall of said recess is established that is smaller than the diameter of said fiber bundle.

9. The spinning frame according to claim 3, wherein said restriction means is provided at a distance from the center of said inner rotor that is substantially equal to the radius of said fiber collecting section.

10. The spinning frame according to claim 3, wherein said restriction means is provided at a greater distance from the center of said inner rotor than the radius of said fiber collecting section.

11. A spinning frame according to claim 1, wherein said first passage and said second passage have entrances that face said fiber collecting section, said entrance of said second passage having a greater width than the width of said first passage.

12. A spinning frame according to claim 1 further comprising a negative pressure generator located downstream of said conduit member along a direction in which said fiber bundle is drawn during normal spinning for generating negative pressure in said conduit member.

13. The spinning frame according to claim 1, wherein said inner rotor is disposed at a position on the opposite side of an imaginary plane passing through said fiber collecting section and facing said open end of sand outer rotor, said restriction means is a navel whose distal end is provided movable between a position corresponding to said imaginary plane and a spinning position at which said distal end enters a recess formed in said inner rotor, and said second passage is spaced between said distal end of said navel located at a position corresponding to said imaginary plane and said first passage.

14. The spinning frame according to claim 1, wherein said second passage is formed in said inner rotor wider than at least an entrance of said first passage, and said restriction means is a navel whose distal end is provided movable between a position corresponding to an imaginary plane where said fiber collecting section lies, and a spinning position at which said distal end enters a recess formed in said inner rotor.

15. A method for piecing a yarn, which comprises:

supplying unraveled fibers into an outer rotor;

collecting said unraveled fibers at a fiber collecting section of the outer rotor in accordance with the rotation of the outer rotor to form a fiber bundle;

supplying a standard thread to said fiber collecting section via a yarn piecing passage of an inner rotor;

piecing said standard thread to said fiber bundle while rotating said inner rotor independently of said outer rotor;

guiding said fiber bundle, pieced to said standard thread, to a yarn spinning passage different from said yarn piecing passage; and drawing said fiber bundle from said yarn spinning passage while applying a twist to the fiber bundle to make a yarn.

16. A method according to claim 15, wherein said drawing further includes inhibiting said twist from propagating to said fiber bundle in said fiber collecting section via said fiber bundle in said yarn spinning passage.

* * * * *